US010242829B2

(12) United States Patent
Hasegawa et al.

(10) Patent No.: US 10,242,829 B2
(45) Date of Patent: Mar. 26, 2019

(54) ELECTROMAGNETIC RELAY AND COIL TERMINAL

(71) Applicant: FUJITSU COMPONENT LIMITED, Tokyo (JP)

(72) Inventors: Yoichi Hasegawa, Tokyo (JP); Daiei Iwamoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/322,282

(22) PCT Filed: May 12, 2015

(86) PCT No.: PCT/JP2015/063672
§ 371 (c)(1),
(2) Date: Dec. 27, 2016

(87) PCT Pub. No.: WO2016/017231
PCT Pub. Date: Feb. 4, 2016

(65) Prior Publication Data

US 2017/0133183 A1 May 11, 2017

(30) Foreign Application Priority Data

Jul. 28, 2014 (JP) ..... 2014-152869

(51) Int. Cl.
*H01H 3/00* (2006.01)
*H01H 50/14* (2006.01)
(Continued)

(52) U.S. Cl.
CPC ..... *H01H 50/14* (2013.01); *H01H 50/02* (2013.01); *H01H 50/38* (2013.01);
(Continued)

(58) Field of Classification Search
CPC ..... H01H 50/14; H01H 50/02; H01H 50/22; H01H 50/24; H01H 50/28; H01H 50/36;
(Continued)

(56) References Cited

U.S. PATENT DOCUMENTS 3,017,474 A * 1/1962 Huetten ..... H01H 50/20 335/179
3,792,398 A 2/1974 Norlin et al.
(Continued)

FOREIGN PATENT DOCUMENTS

CN 1499558 5/2004
CN 102820172 12/2012
(Continued)

OTHER PUBLICATIONS

Japan Platform for Patent Information, Publication No. 2013-196783, published Sep. 30, 2013.
(Continued)

*Primary Examiner* — Shawki S Ismail
*Assistant Examiner* — Lisa N Homza
(74) *Attorney, Agent, or Firm* — Staas & Halsey LLP

(57) ABSTRACT

An electromagnetic relay includes: a base; a pair of fixed contact terminals, each including a fixed contact and a first fulcrum fixed to the base; a movable contact spring including a pair of movable pieces, each of the movable pieces including a movable contact contacting and separating from the fixed contact; an armature that is coupled with the movable contact spring, by a rotary motion around a second fulcrum; an electromagnetic device that drives the armature; and a permanent magnet arranged between the pair of fixed contact terminals and between the pair of movable pieces to generate a magnetic field. The first fulcrum and the second fulcrum are arranged mutually in opposite directions with respect to the movable contact or the fixed contact.

13 Claims, 15 Drawing Sheets

(51) Int. Cl.

| | |
|---|---|
| ***H01H 50/38*** | (2006.01) |
| ***H01H 50/56*** | (2006.01) |
| ***H01H 50/02*** | (2006.01) |
| ***H01H 50/44*** | (2006.01) |
| ***H01H 50/58*** | (2006.01) |
| *H01H 1/26* | (2006.01) |
| *H01H 9/44* | (2006.01) |
| *H01H 50/24* | (2006.01) |

(52) U.S. Cl.
CPC ..... *H01H 50/443* (2013.01); *H01H 50/56* (2013.01); *H01H 50/58* (2013.01); *H01H 1/26* (2013.01); *H01H 9/443* (2013.01); *H01H 50/24* (2013.01)

(58) Field of Classification Search
CPC ..... H01H 50/38; H01H 50/54; H01H 50/56; H01H 50/58; H01H 50/60; H01H 1/06; H01H 33/182; H01H 51/2236; H01H 51/2254
USPC ..... 335/189
See application file for complete search history.

(56) References Cited

U.S. PATENT DOCUMENTS 4,112,400 A * 9/1978 Jaidinger ..... H01H 50/041 335/128
4,380,000 A 4/1983 Nicolaisen
4,404,443 A * 9/1983 Coynel ..... H01H 1/62 218/23
5,041,870 A * 8/1991 Imai ..... H01H 50/042 335/202
5,239,281 A * 8/1993 Tomono ..... H01H 50/042 335/128
6,075,429 A 6/2000 Uotorne et al.
6,265,958 B1 * 7/2001 Yoshino ..... H01H 50/023 335/128
6,359,537 B1 * 3/2002 Ichikawa ..... H01H 49/00 335/78
6,483,407 B1 11/2002 Matsuda et al.
6,496,090 B1 * 12/2002 Nishida ..... H01H 50/023 335/128
6,879,229 B2 * 4/2005 Tanaka ..... H01H 50/46 335/128
6,903,639 B2 * 6/2005 Sanada ..... H01H 50/023 335/129
6,922,122 B2 * 7/2005 Saruwatari ..... H01H 50/326 335/113
6,924,719 B2 * 8/2005 Saruwatari ..... H01H 50/08 335/17
6,933,815 B2 * 8/2005 Saruwatari ..... H01H 50/08 335/17
7,205,870 B2 * 4/2007 Sanada ..... H01H 50/642 335/128
7,782,162 B2 * 8/2010 Nishida ..... H01H 50/56 335/201
8,164,404 B2 * 4/2012 Kamiya ..... H01H 9/04 218/157
8,493,164 B2 * 7/2013 Kurihara ..... H01H 50/047 335/78
9,007,156 B2 * 4/2015 Hiraiwa ..... H01H 9/443 335/78
2002/0036556 A1 * 3/2002 Matsuda ..... H01H 50/12 335/78
2004/0113729 A1 6/2004 Sanada et al.
2004/0119566 A1 * 6/2004 Sanada ..... H01H 50/56 335/128
2005/0046527 A1 * 3/2005 Chida ..... H01H 50/002 335/78
2005/0057332 A1 * 3/2005 Nakamura ..... H01H 50/042 335/128
2006/0022778 A1 * 2/2006 Minowa ..... H01H 50/36 335/128
2008/0180197 A1 * 7/2008 Kubono ..... H01H 50/043 335/78
2009/0072935 A1 * 3/2009 Yuba ..... H01H 9/443 335/201
2009/0134962 A1 5/2009 Nishida
2010/0066468 A1 * 3/2010 Iwamoto ..... H01H 50/026 335/128
2010/0117769 A1 * 5/2010 Kuo ..... H01H 50/026 335/78
2011/0254645 A1 * 10/2011 Kubono ..... H01H 50/14 335/127
2012/0313737 A1 * 12/2012 Iwamoto ..... H01H 50/56 335/185
2013/0037517 A1 * 2/2013 Yuba ..... H01H 15/02 218/23
2013/0037518 A1 * 2/2013 Iwamoto ..... H01H 1/26 218/26
2013/0037519 A1 * 2/2013 Yuba ..... H01H 9/42 218/144
2013/0057370 A1 * 3/2013 Kubono ..... H01H 50/643 335/177
2013/0086754 A1 * 4/2013 Hendrickson ..... D06F 39/003 8/137
2013/0088311 A1 4/2013 Yano et al.
2013/0240495 A1 9/2013 Yano et al.
2013/0257566 A1 * 10/2013 Li ..... H01H 51/22 335/127
2013/0285774 A1 * 10/2013 Hasegawa ..... H01H 3/28 335/189
2014/0015628 A1 * 1/2014 Shinkai ..... H01H 50/26 335/189
2014/0022035 A1 * 1/2014 Yamashita ..... H01H 9/443 335/201
2014/0028418 A1 * 1/2014 Yamashita ..... H01H 9/40 335/201
2014/0159837 A1 6/2014 Hiraiwa et al.
2014/0232489 A1 * 8/2014 Kubono ..... H01H 50/54 335/83
2015/0042425 A1 * 2/2015 Sumino ..... H01H 50/643 335/189
2015/0048909 A1 * 2/2015 Heinrich ..... H01H 50/041 335/85
2015/0054604 A1 * 2/2015 Kubono ..... H01H 50/36 335/177
2015/0054605 A1 * 2/2015 Kubono ..... H01H 50/60 335/177
2015/0187527 A1 * 7/2015 Kubono ..... H01H 50/44 361/206
2016/0027602 A1 * 1/2016 Hasegawa ..... H01H 50/58 335/189
2016/0086754 A1 * 3/2016 Shimoda ..... H01H 50/28 335/2
2016/0372286 A1 * 12/2016 Kubono ..... H01H 9/443
2017/0133183 A1 * 5/2017 Hasegawa ..... H01H 50/14
2017/0162353 A1 * 6/2017 Kubono ..... H01H 50/28
2017/0162354 A1 * 6/2017 Kubono ..... H01H 50/54

FOREIGN PATENT DOCUMENTS

| | | |
|---|---|---|
| EP | 1 164 613 A1 | 12/2001 |
| EP | 2 037 471 A1 | 3/2009 |
| EP | 2 533 262 A1 | 12/2012 |
| EP | 2 639 811 A1 | 9/2013 |
| EP | 2 672 497 A1 | 12/2013 |
| JP | 60-107552 | 7/1985 |
| JP | 60-162351 | 10/1985 |
| JP | 63-157143 | 10/1988 |
| JP | 2570248 | 6/1993 |
| JP | 10-326553 | 12/1998 |
| JP | 2000-67725 | 3/2000 |
| JP | 2006-210018 | 8/2006 |
| JP | 4810937 | 3/2007 |
| JP | 5202072 | 4/2009 |
| JP | 2012-190764 | 10/2012 |
| JP | 5085754 | 10/2012 |

(56) References Cited

FOREIGN PATENT DOCUMENTS

| | | |
|---|---|---|
| JP | 2013-80692 | 5/2013 |
| JP | 2013-196783 | 9/2013 |
| JP | 2014-116165 | 6/2014 |
| KR | 10-0404770 | 11/2001 |
| KR | 10-2009-0028396 | 3/2009 |
| KR | 10-2012-0135861 | 12/2012 |
| WO | WO 2011/115056 A1 | 9/2011 |

OTHER PUBLICATIONS

Japan Platform for Patent Information, Publication No. 2012-190764, published Oct. 4, 2012.
Japan Platform for Patent Information, Publication No. 2014-116165, published Jun. 26, 2014.
Japan Platform for Patent Information, Publication No. 2000-67725, published Mar. 3, 2000.
Japan Platform for Patent Information, Publication No. 2013-80692, published May 2, 2013.
Japan Platform for Patent Information, Publication No. 10-326553, published Dec. 8, 1998.
International Search Report dated Aug. 4, 2015 in corresponding International Application No. PCT/JP2015/063672.
Office Action for Chinese Patent Application No. 201580036898.0, dated Feb. 26, 2018.
Espacenet English Abstract for Chinese Publication No. 1499558, published May 26, 2004.
Espacenet English Abstract for Chinese Publication No. 102820172, published Dec. 12, 2012.
Extended European Search Report dated Jul. 25, 2018 in European Patent Application No. 18166379.0, 6 pgs.
Partial Supplementary European Search Report dated May 24, 2018, in corresponding European Patent Application No. 15827238.5, 10 pgs.
Office Action for Japanese Patent Application No. 2014-152869, dated Aug. 28, 2018.
Office Action for Korean Patent Application No. 10-2016-7034278, dated Dec. 19, 2017.
KIPRIS English Abstract for Korean Patent Application No. 10-2009-0028396, published Mar. 18, 2009.
KIPRIS English Abstract for Korean Patent Application No. 10-0404770, published Nov. 24, 2001.
KIPRIS English Abstract for Korean Patent Application No. 10-2012-0135861, published Dec. 17, 2012.
J-Plat-Pat English Abstract for Japanese Patent Application No. 2006-210018, published Aug. 10, 2006.

* cited by examiner

Prior Art

ELECTROMAGNETIC RELAY AND COIL TERMINAL

TECHNICAL FIELD

The present invention relates to an electromagnetic relay and a coil terminal.

BACKGROUND ART

There has been known an electromagnetic relay in which a permanent magnet for extinguishing a magnetic arc generates a magnetic flux between relay contacts and an arc generated between the relay contacts is extended by Lorentz force and extinguished. For example, each of electromagnetic relays of Patent Documents 1-4 is known as an electromagnetic relay including a plurality of permanent magnets for extinguishing the magnetic arc. Moreover, each of electromagnetic relays of Patent Documents 2, 3 and 5-7 is known as an electromagnetic relay extending the arc in a single direction.

PRIOR ART DOCUMENT

[Patent Document 1] Japanese Laid-open Patent Publication No. 2013-196783
[Patent Document 2] Japanese Patent No. 5085754
[Patent Document 3] Japanese Patent No. 4810937
[Patent Document 4] Japanese Laid-open Patent Publication No. 2000-67725
[Patent Document 5] Japanese Patent No. 5202072
[Patent Document 6] Japanese Utility Model Application Laid-Open Publication No. 63-157143

SUMMARY OF THE INVENTION

Each of electromagnetic relays of above-mentioned Patent Documents 1-4 includes the plurality of permanent magnets for extinguishing the magnetic arc, and therefore there is a problem that a manufacturing cost increases, compared with an electromagnetic relay including a single permanent magnet for extinguishing the magnetic arc.

Each of electromagnetic relays of above-mentioned Patent Documents 2, 3 and 5-7 extends the arc in a single direction. However, the arc may not be extended effectively according to the direction of a current flowing between a fixed contact and a movable contact. That is, in each of the electromagnetic relays of above-mentioned Patent Documents 2, 3 and 5-7, there is a problem that a difference occurs in an extinguishing capability of the arc according to the direction of the current flowing between the movable contact and the fixed contact.

It is an object of the present invention to provide an electromagnetic relay and a coil terminal that can extinguish the arc effectively regardless of the direction of the current flowing between the movable contact and the fixed contact, and reduce the manufacturing cost.

To achieve the above-mentioned object, an electromagnetic relay disclosed herein includes: a base; a pair of fixed contact terminals each including a fixed contact and a lower portion fixed to the base; a movable contact spring including a pair of movable pieces, each of the movable pieces including a movable contact contacting and separating from the fixed contact; an armature that is coupled with the movable contact spring, and moves the movable contact spring by a rotary motion around a fulcrum; an electromagnetic device that drives the armature; and a permanent magnet that is arranged between the pair of fixed contact terminals and between the pair of movable pieces, and generates a magnetic field; wherein the first lower portions of the fixed contact terminals and the fulcrum are arranged mutually in opposite directions with respect to the movable contact or the fixed contact.

A coil terminal disclosed herein that is formed by bending a piece of metal plate includes: a vertical portion that restricts the movement of the coil terminal in a horizontal direction; a horizontal portion that restricts the movement of the coil terminal in a vertical direction; a leg portion that extends vertically downward from the vertical portion, and is connected to a power supply; and a coil binding portion that is stood obliquely from one end of the horizontal portion, and around which a coil is wound.

According to the present invention, it is possible to extinguish the arc effectively regardless of the direction of the current flowing between the movable contact and the fixed contact, and reduce the manufacturing cost.

DETAILED DESCRIPTION

Hereinafter, a description will be given of embodiments with drawings.

Figure 1:
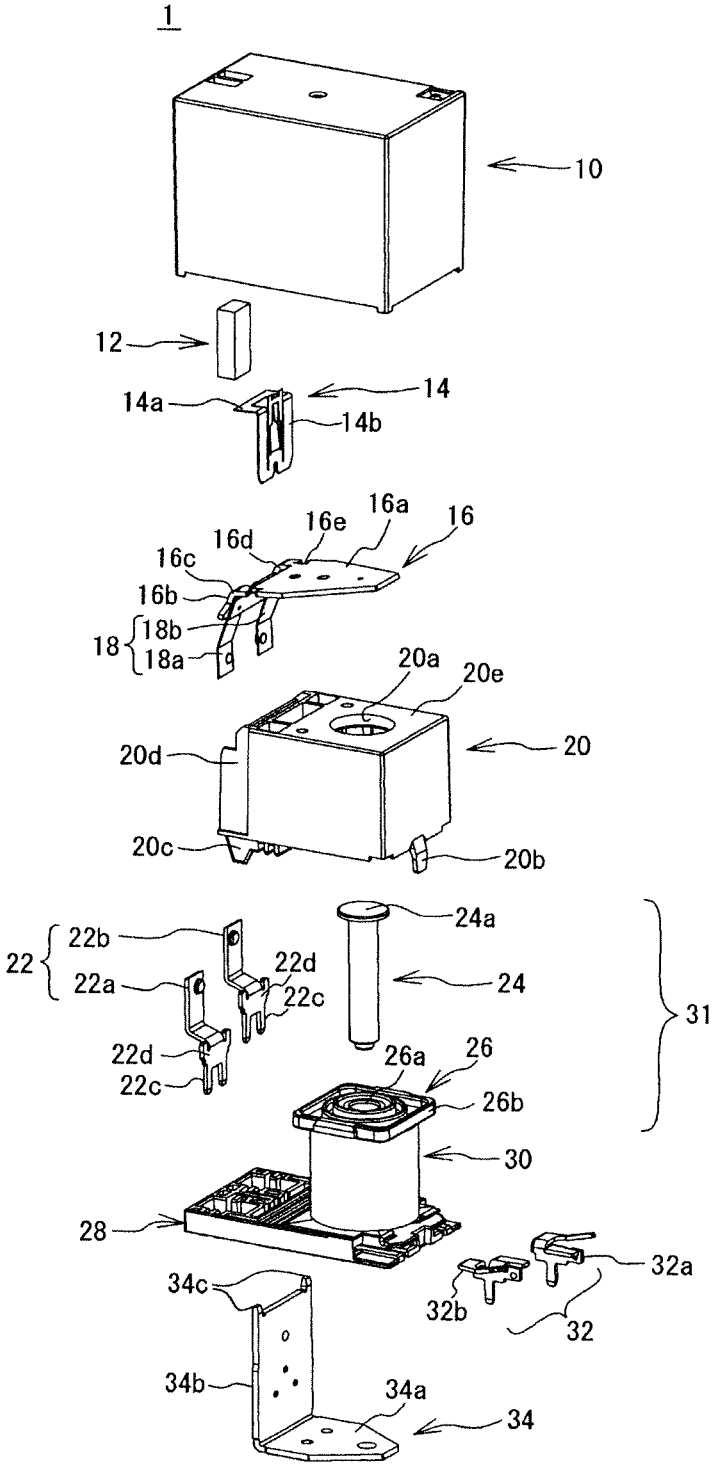
FIG. 1 is an exploded view of an electromagnetic relay (relay) 1 according to a present embodiment.
Figure 2:
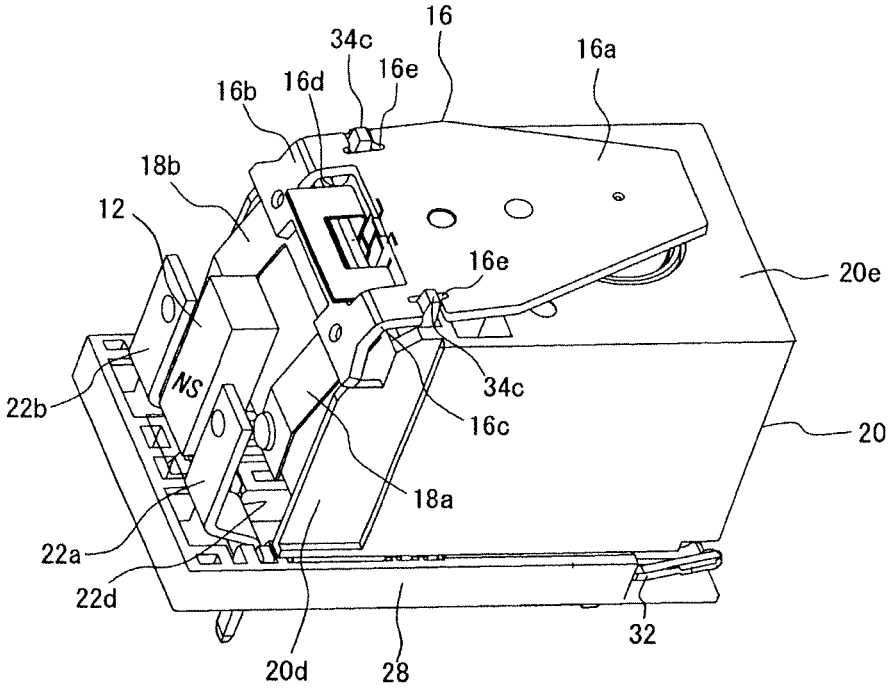
FIG. 2 is a perspective view of the relay 1.

FIG. 1 is an exploded view of an electromagnetic relay (hereinafter referred to as "relay") 1 according to a present embodiment. FIG. 2 is a perspective view of the relay 1.

The relay 1 according to the present embodiment is a direct current (DC) high voltage type relay, and is used as a relay for battery pre-charge (prevention of an inrush current to a main relay contact) of an electric vehicle, for example. Here, the DC high voltage does not mean a high voltage prescribed in IEC (International Electrotechnical Commission) but means a voltage more than 12 VDC or 24 VDC used in a general car battery, for example.

The relay 1 has to reliably extinguish an arc generated between a fixed contact and a movable contact at the time of load block of the DC high voltage. In the general DC high voltage type relay, a polarity is designated to connection of a load side. However, in the relay 1 which is the relay for battery pre-charge, current directions reverse each other at the time of battery charging and discharging, and it is therefore required that the polarity of connection of the load side is not designated. Therefore, the relay 1 has to extinguish the arc regardless of a direction of the current flowing between the movable contact and the fixed contact. Here, the use of the relay 1 is not limited to the electric vehicle, and the relay 1 can be used for various devices and facilities.

As illustrated in FIG. 1, the relay 1 includes a case 10, a permanent magnet 12 for extinguishing magnetic arc, a hinge spring 14, an armature 16, a movable contact spring 18, an insulating cover 20, fixed contact terminals 22 (22*a* and 22*b*), an iron core 24, a spool 26, a base 28, a coil 30, a pair of coil terminals 32 (32*a* and 32*b*), and a yoke 34. The pair of coil terminals 32 (32*a* and 32*b*) supplies a current to excite an electromagnetic device composed of the iron core 24, the spool 26 and the coil 30.

Figure 3A:
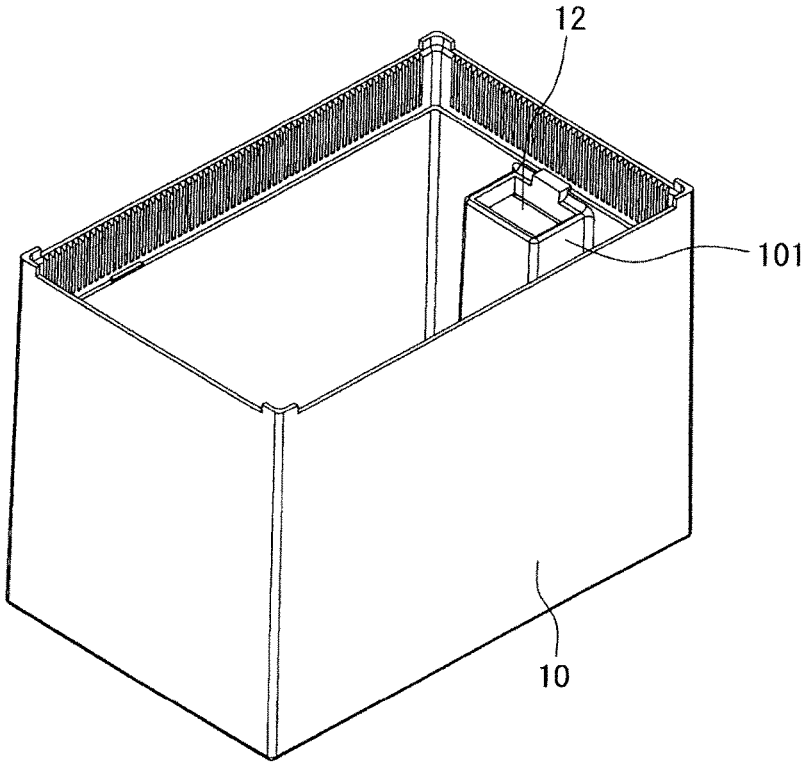
FIG. 3A is a diagram illustrating internal structure of a case 10.

As illustrated in FIG. 3A, a magnet holder 101 is formed in the inside of the case 10, and the permanent magnet 12 is held in the magnet holder 101. The permanent magnet 12 held in the magnet holder 101 is arranged between the fixed contact terminals 22*a* and 22*b*, as illustrated in FIG. 2. In FIG. 2, the case 10 is omitted. For example, a surface having an N-pole of the permanent magnet 12 is directed to a side of the fixed contact terminal 22*b*, and a surface having an S-pole of the permanent magnet 12 is directed to a side of the fixed contact terminal 22*a*. The positions of the surface having the N-pole and the surface having the S-pole may be reversed each other. Moreover, a samarium cobalt magnet which is superior in residual flux density, coercive force and heat resistance is used as the permanent magnet 12, for example. Especially, since the heat of the arc reaches the permanent magnet 12, the samarium cobalt magnet which is superior in the heat resistance to a neodymium magnet is used.

Referring to FIG. 1, the hinge spring 14 is formed in an inverted L-shape in a side view, and includes a horizontal portion 14*a* that biases a suspended portion 16*b* of the armature 16 downward, and a suspended portion 14*b* that is fixed to a vertical portion 34*b* of the yoke 34.

Figure 3B:
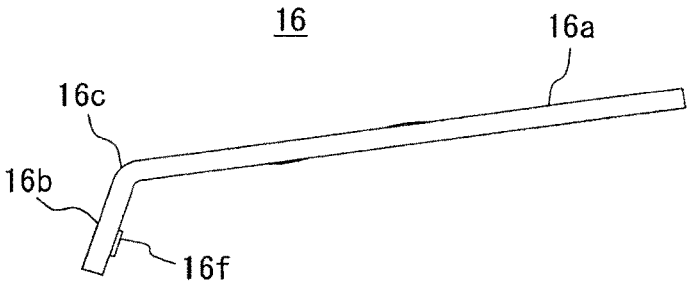
FIG. 3B is a side view of an armature 16.

The armature 16 is a magnetic body having a dogleg-shape in a side view, and includes a flat plate portion 16*a* that is attracted by the iron core 24, and the suspended portion 16*b* extending downward from the flat plate portion 16*a* via a bent portion 16*c*, as illustrated in FIG. 3B. Moreover, a through-hole 16*d* is formed in the center of the bent portion 16*c* so that the horizontal portion 14*a* of the hinge spring 14 protrudes, as illustrated in FIGS. 1 and 2. Cutout portions 16*e* into which projecting portions 34*c* of the yoke 34 are fitted are formed on the flat plate portion 16*a*. Projections 16*f* (see FIG. 3B) for fixing the movable contact spring 18 to the suspended portion 16*b* by caulking are provided on the suspended portion 16*b*.

The armature 16 performs rotary motion with the cutout portions 16*e*, as a fulcrum, into which the projecting portions 34*c* of the yoke 34 are fitted. When a current flows into the coil 30, the iron core 24 attracts the flat plate portion 16*a*. At this time, the horizontal portion 14*a* of the hinge spring 14 contacts the suspended portion 16*b* and is pushed upward from the suspended portion 16*b*. When the current of the coil 30 is cut off, the suspended portion 16*b* is pushed down by a restoring force of the horizontal portion 14*a* of the hinge spring 14. Thereby, the flat plate portion 16*a* is separated from the iron core 24. Here, a surface of the flat plate portion 16*a* opposite to the iron core 24 or the insulating cover 20 is defined as a first surface, and a rear surface of the first surface is defined as a second surface. Moreover, a surface of the suspended portion 16*b* opposite to the yoke 34 or the insulating cover 20 is defined as a first surface, and a rear surface of the first surface is defined as a second surface.

Figure 4A:
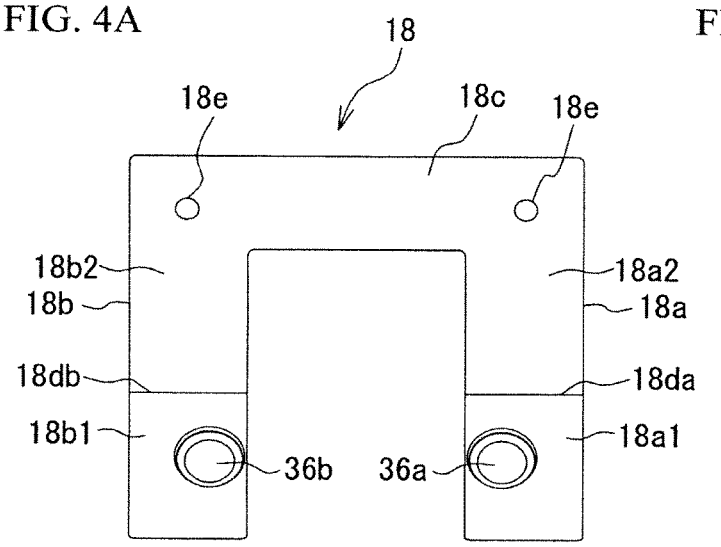
FIG. 4A is a front view of a movable contact spring 18.
Figure 4B:
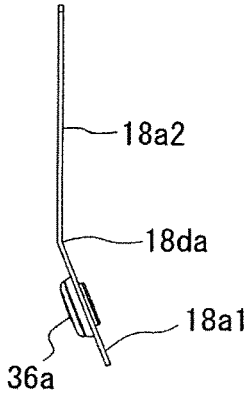
FIG. 4B is a side view of the movable contact spring 18.
Figure 4C:
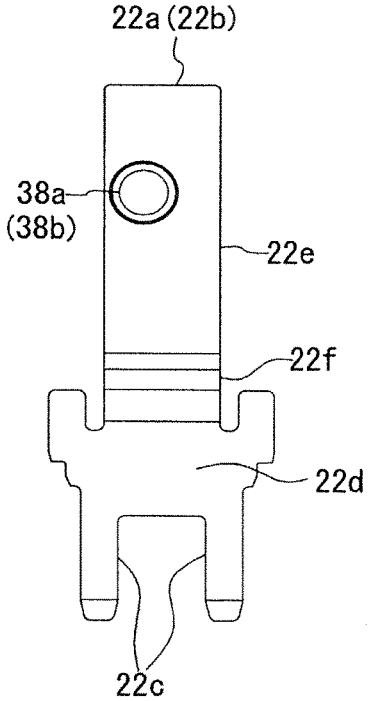
FIG. 4C is a front view of fixed contact terminals 22*a* and 22*b;*
Figure 4D:
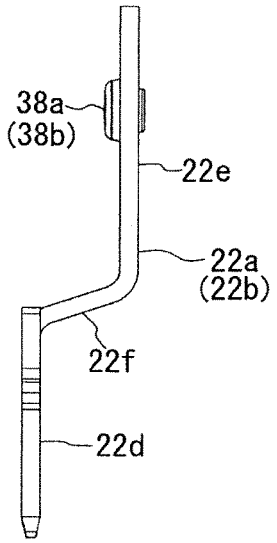
FIG. 4D is a side view of the fixed contact terminals 22*a* and 22*b;*

FIG. 4A is a front view of the movable contact spring 18, and FIG. 4B is a side view of the movable contact spring 18. FIG. 4C is a front view of fixed contact terminals 22*a* and 22*b*, and FIG. 4D is a side view of the fixed contact terminals 22*a* and 22*b*.

The movable contact spring 18 is a conductive plate spring having a U shape in a front view, and includes a pair of movable pieces, i.e., a first movable piece 18*a* and a second movable piece 18*b*, and a coupling portion 18*c* that couples upper ends of the first movable piece 18*a* and the second movable piece 18*b* with each other.

The first movable piece 18*a* and the second movable piece 18*b* are bent at positions 18*da* and 18*db* which are nearer to the bottom ends than the centers, respectively. Here, a portion below the position 18*da* of the first movable piece 18*a* is defined as a lower portion 18*a*1, and a portion above the position 18*da* of the first movable piece 18*a* is defined as an upper portion 18*a*2. Similarly, a portion below the position 18*db* of the second movable piece 18*b* is defined as a lower portion 18*b*1, and a portion above the position 18*db* of the second movable piece 18*b* is defined as an upper portion 18*b*2.

A movable contact 36*a* composed of a material having excellent arc resistance is provided on the lower portion 18*a*1 of the first movable piece 18*a*. A movable contact 36*b* composed of a material having excellent arc resistance is provided on the lower portion 18*b*1 of the second movable piece 18*b*. In the first movable piece 18*a* and the second movable piece 18*b*, the upper portion 18*a*2 of the first movable piece 18*a* and the upper portion 18*b*2 of the second movable piece 18*b* are bent in a direction away from fixed contacts 38*a* and 38*b* (i.e., a fixed contact and a second fixed contact) mentioned later which the movable contacts 36*a* and 36*b* (i.e., a first movable contact and a second movable contact) contact, respectively.

Through-holes 18*e* into which the projections 16*f* provided on the suspended portion 16*b* are fitted are formed on the coupling portion 18*c*. The projections 16*f* are fitted and caulked into the through-holes 18*e*, so that the movable contact spring 18 is fixed to the first surface of the suspended portion 16*b* of the armature 16.

The fixed contact terminals 22*a* and 22*b* are press-fitted to through-holes, not shown, provided on the base 28 from above, and are fixed to the base 28. The fixed contact terminals 22*a* and 22*b* are bent like a crank in a side view. Each of the fixed contact terminals 22*a* and 22*b* includes an upper portion 22*e*, an inclined portion 22*f* and a lower portion 22*d*. The upper portion 22*e* is coupled with the lower portion 22*d* via the inclined portion 22*f*, and the upper portion 22*e*, the inclined portion 22*f* and the lower portion 22*d* are integrally formed. The upper portion 22*e* is bent so as to be spaced from the movable contact spring 18 or the insulating cover 20 more than the lower portion 22*d*. The fixed contacts 38*a* and 38*b* composed of a material having excellent arc resistance are provided on the upper portions 22*e* of the fixed contact terminals 22*a* and 22*b*, respectively. A bifurcated terminal 22*c* to be connected to a power supply, not shown, is provided on the lower portions 22*d* of the fixed contact terminals 22*a* and 22*b*.

Referring to FIG. 1, the insulating cover 20 is made of resin, and a through-hole 20*a* exposing a head portion 24*a* of the iron core 24 is formed on a ceiling portion 20*e* of the insulating cover 20. Projection-shaped fixing portions 20*b* (i.e., a first fixing portion) and 20*c* (i.e., a second fixing portion) are formed on a bottom portion of the insulating cover 20 to fix the insulating cover 20 to the base 28. The fixing portion 20*b* engages with one end of the base 28, and the fixing portion 20*c* is inserted into a hole, not shown, of the base 28. Moreover, a back stop 20*d* made of resin is integrally formed with the insulating cover 20. When the current does not flow into the coil 30 (i.e., when an electromagnetic device 31 mentioned later is OFF), the back stop 20*d* as a stopper contacts the movable contact spring 18. By the back stop 20*d*, the occurrence of a collision sound of metal parts such as the movable contact spring 18 and the yoke 34 can be suppressed. Therefore, an operating sound of the relay 1 can be reduced.

The iron core 24 is inserted into a through-hole 26*a* formed on a head portion 26*b* of the spool 26. The coil 30 is wound around the spool 26, and integrally formed with the base 28. The iron core 24, the spool 26 and the coil 30 constitute the electromagnetic device 31. The electromagnetic device 31 attracts the flat plate portion 16*a* of the armature 16 or releases the attraction thereof in accordance with ON/OFF of the current. Thereby, opening or closing action of the movable contact spring 18 against the fixed contact terminals 22*a* and 22*b* is carried out. The pair of coil terminals 32 is press-fitted into the base 28, and the wiring of the coil 30 is entwined with each of the pair of coil terminals 32.

The yoke 34 is an L-shaped conductive member in a side view, and includes a horizontal portion 34*a* that is fixed to a rear surface of the base 28, and the vertical portion 34*b* that is erected vertically to the horizontal portion 34*a*. The vertical portion 34*b* is press-fitted into a through-hole, not shown, of the base 28 and a through-hole, not shown, of the insulating cover 20 from the bottom of the base 28. Thereby, the projecting portions 34*c* provided on both ends of the top of the vertical portion 34*b* protrude from the ceiling portion 20*e* of the insulating cover 20, as illustrated in FIG. 2.

Figure 5A:
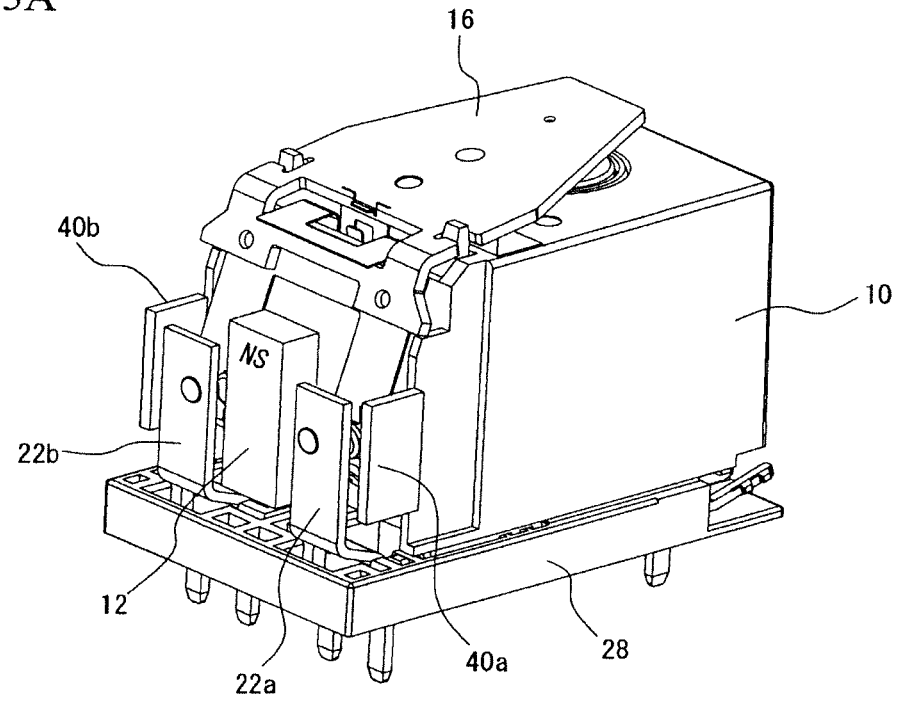
FIGS. 5A and 5B are diagrams illustrating variations of the relay 1.
Figure 5B:
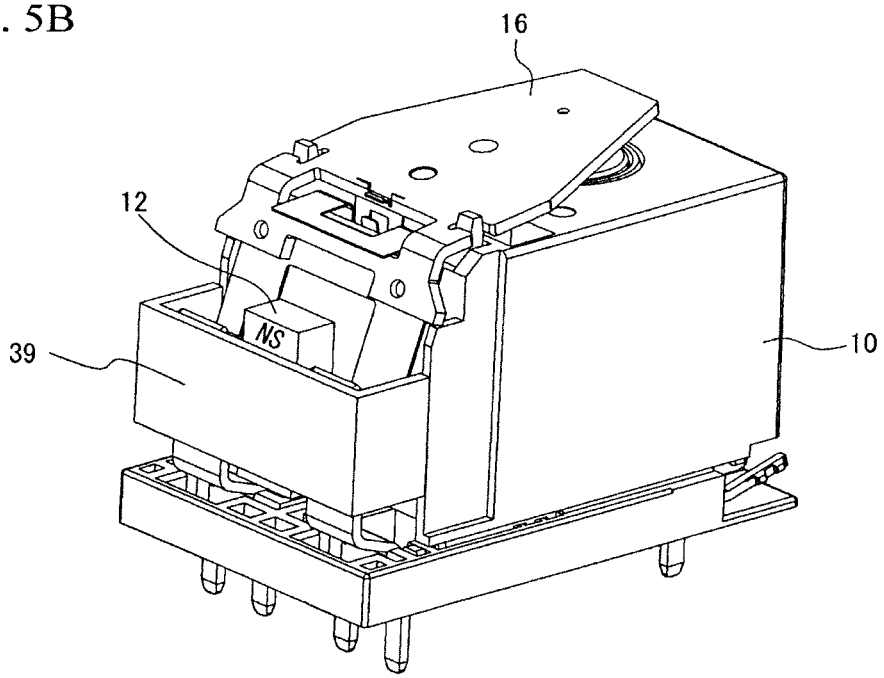

Here, to stabilize a direction of the magnetic flux of the permanent magnet 12 and to reduce leak magnetic flux, two plate-like yokes 40*a* and 40*b* may be provided, as illustrated in FIG. 5A. In this case, the yoke 40*a* is arranged opposite to the surface having the pole (e.g. the S-pole) of the permanent magnet 12, and is arranged so that the permanent magnet 12 and the yoke 40*a* sandwich the fixed contact terminal 22*a*. The yoke 40*b* is arranged to opposite to the surface having the pole (e.g. the N-pole) of the permanent magnet 12, and is arranged so that the permanent magnet 12 and the yoke 40*b* sandwich the fixed contact terminal 22*b*. Alternatively, to stabilize the direction of the magnetic flux of the permanent magnet 12 and to reduce the leak magnetic flux, a U-shaped yoke 39 may be provided, as illustrated in FIG. 5B. In this case, the yoke 39 is arranged opposite to two surfaces having respective poles of the permanent magnet 12, and is arranged so as to surround the permanent magnet 12 and the fixed contact terminals 22*a* and 22*b*.

Figure 6A:
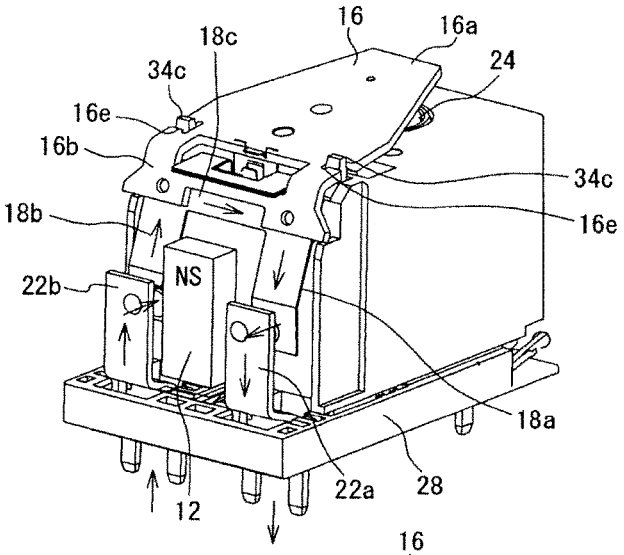
FIG. 6A is a diagram schematically illustrating a direction of a current flowing into the relay 1.
Figure 6B:
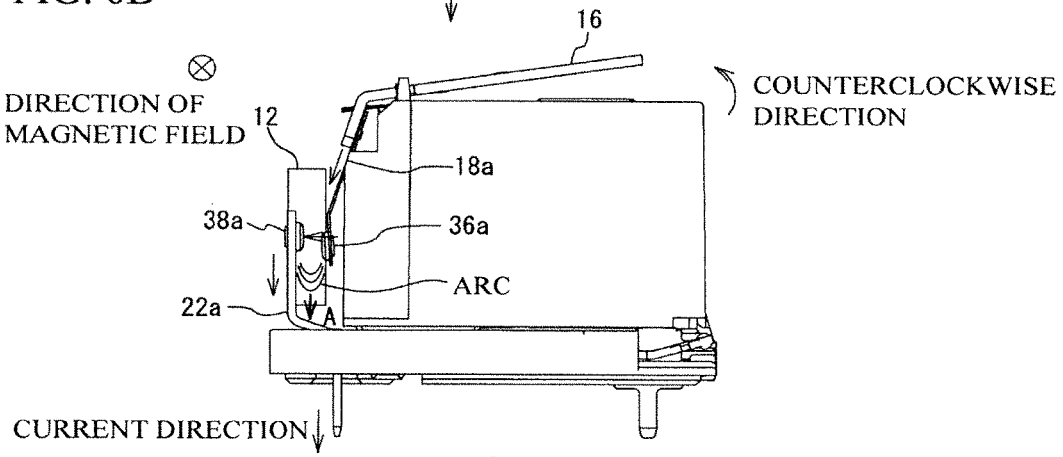
FIG. 6B is a diagram illustrating an arc-extinguishing state as viewed from a side of the fixed contact terminal 22*a;*
Figure 6C:
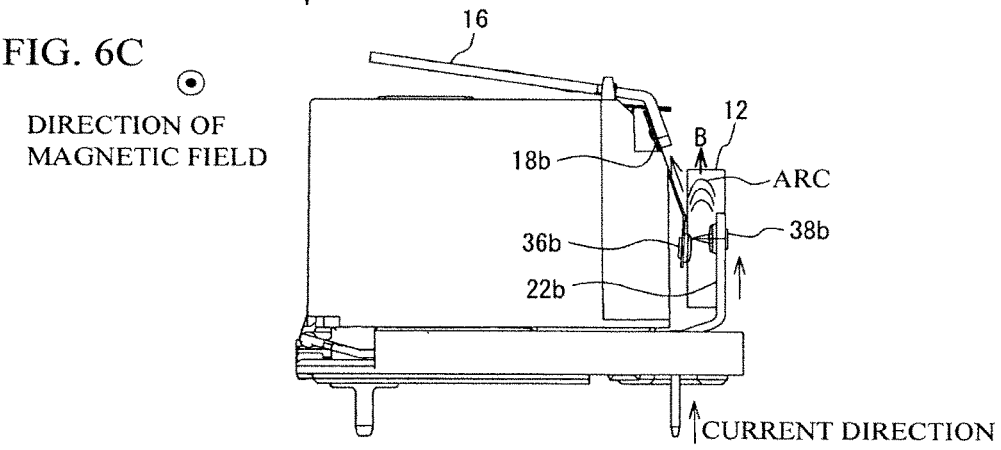
FIG. 6C is a diagram illustrating an arc-extinguishing state as viewed from a side of the fixed contact terminal 22*b;*

FIG. 6A is a diagram schematically illustrating a direction of a current flowing into the relay 1, and especially illustrates a state where the fixed contacts and the movable contacts are separated. FIG. 6B is a diagram illustrating an arc-extinguishing state as viewed from a side of the fixed contact terminal 22*a*, and FIG. 6C is a diagram illustrating an arc-extinguishing state as viewed from a side of the fixed contact terminal 22*b*. In FIGS. 6A to 6C, a direction (a first direction) in which the current flows is indicated by arrows.

In FIG. 6A, any one of the fixed contact terminals 22*a* and 22*b* is connected to a power supply side, not shown, and the other is connected to a load side, not shown. When the current flows into the coil 30, the iron core 24 attracts the flat plate portion 16*a*, and the armature 16 rotates with the projecting portions 34*c* and the cutout portions 16*e* as fulcrums. The suspended portion 16*b* and the movable contact spring 18 fixed to the suspended portion 16*b* rotate with the rotation of the armature 16, and the movable contacts 36*a* and 36*b* contact corresponding fixed contacts 38*a* and 38*b*, respectively. When a voltage is applied to the fixed contact terminal 22*b* in a state where the movable contacts 36*a* and 36*b* contact the fixed contacts 38*a* and 38*b*, for example, the current flows into the fixed contact terminal 22*b*, the fixed contact 38*b*, the movable contact 36*b*, the second movable piece 18*b*, the coupling portion 18*c*, the first movable piece 18*a*, the movable contact 36*a*, the fixed contact 38*a* and the fixed contact terminal 22*a* in this order, as illustrated in FIG. 6A. Then, when the current which flows into the coil 30 is cut off, the armature 16 rotates counterclockwise illustrated in FIG. 6B by the restoring force of the hinge spring 14. Although the movable contacts 36*a* and 36*b* begin to separate from the fixed contacts 38*a* and 38*b* by the rotation of the armature 16, respectively, the current flowing between the movable contact 36*a* and the fixed contact 38*a* and the current flowing between the movable contact 36*b* and the fixed contact 38*b* are not completely interrupted, and the arc occurs between the fixed contacts 38*a* and 38*b* and the movable contacts 36*a* and 36*b*.

In the relay 1 illustrated in FIGS. 6A to 6C, a direction of the magnetic field is a depth direction toward the fixed contact terminal 22*b* from the fixed contact terminal 22*a* as illustrated in FIG. 6B in a place where the current flows from the movable contact 36*a* to the fixed contact 38*a*. Therefore, the arc which occurs between the movable contact 36*a* and the fixed contact 38*a* is extended in a space in a lower direction (a third direction) by Lorentz force as indicated by an arrow A of FIG. 6B and extinguished. On the other hand, in a place where the current flows from the fixed contact 38*b* to the movable contact 36*b*, the direction of the magnetic field is the depth direction toward the fixed contact terminal 22*b* from the fixed contact terminal 22*a* as illustrated in FIG. 6C. Therefore, the arc which occurs between the movable contact 36*b* and the fixed contact 38*b* is extended in a space in an upper direction (a fourth direction) by Lorentz force as indicated by an arrow B of FIG. 6C and extinguished.

Figure 7A:
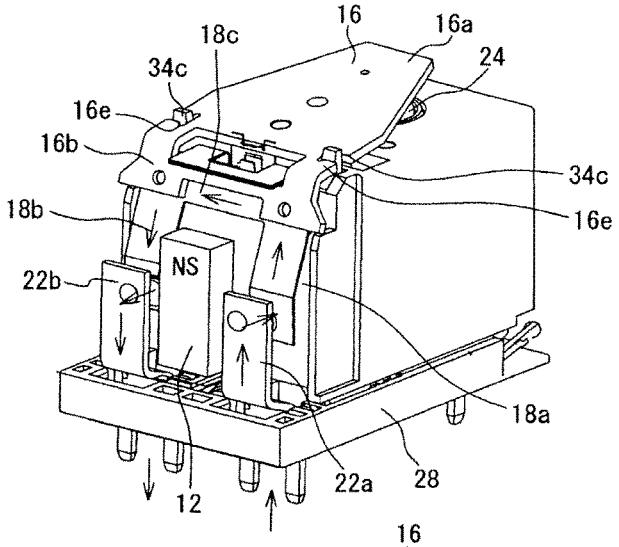
FIG. 7A is a diagram schematically illustrating a direction of a current flowing into the relay 1.
Figure 7B:
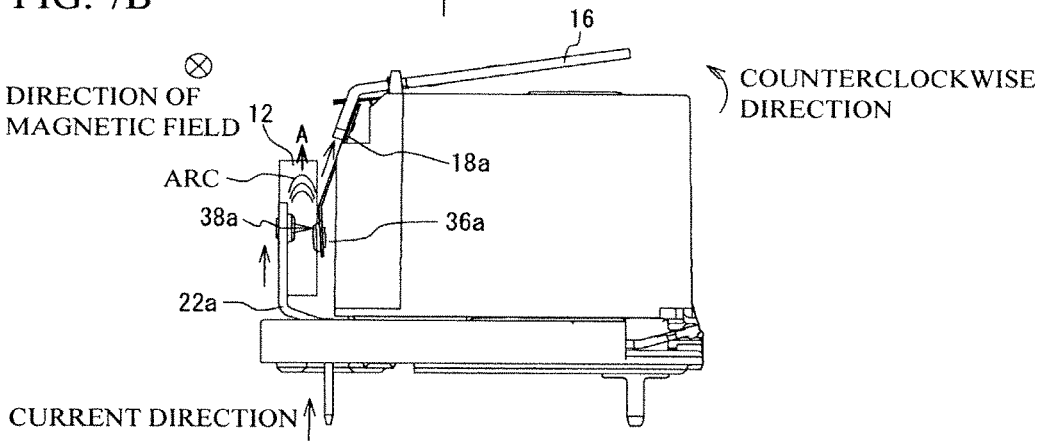
FIG. 7B is a diagram illustrating an arc-extinguishing state as viewed from the side of the fixed contact terminal 22*a;*
Figure 7C:
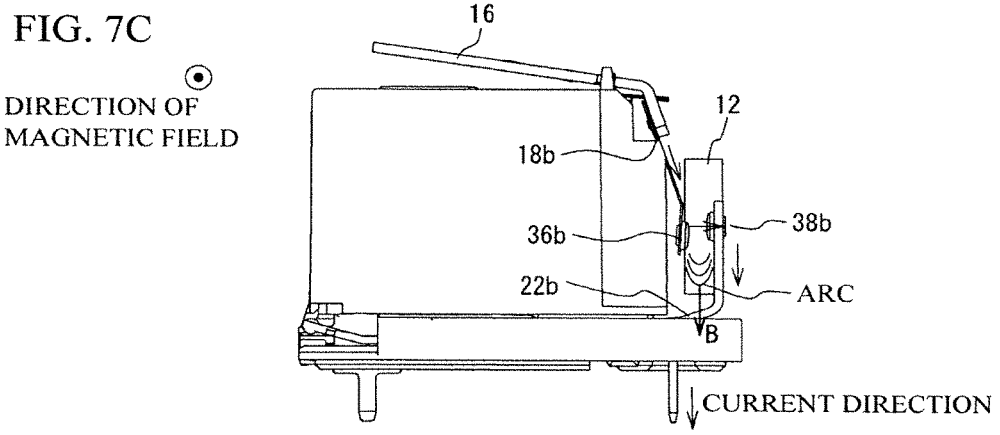
FIG. 7C is a diagram illustrating an arc-extinguishing state as viewed from the side of the fixed contact terminal 22*b;*

FIG. 7A is a diagram schematically illustrating a direction of the current flowing into the relay 1. FIG. 7B is a diagram illustrating an arc-extinguishing state as viewed from the side of the fixed contact terminal 22*a*, and FIG. 7C is a diagram illustrating an arc-extinguishing state as viewed from the side of the fixed contact terminal 22*b*. In FIGS. 7A to 7C, a direction (a second direction) in which the current flows is indicated by arrows. Here, the direction in which the current flows is reversed to the example of FIGS. 6A to 6C.

In FIG. 7A, as with FIG. 6A, any one of the fixed contact terminals 22*a* and 22*b* is connected to the power supply side, not shown, and the other is connected to the load side, not shown. When the current flows into the coil 30, the iron core 24 attracts the flat plate portion 16*a*, and the armature 16 rotates with the projecting portions 34*c* and the cutout portions 16*e* as fulcrums. The suspended portion 16*b* and the movable contact spring 18 fixed to the suspended portion 16*b* rotate with the rotation of the armature 16, and the movable contacts 36*a* and 36*b* contact corresponding fixed contacts 38*a* and 38*b*, respectively. When a voltage is applied to the fixed contact terminal 22*a* in a state where the movable contacts 36*a* and 36*b* contact the fixed contacts 38*a* and 38*b*, for example, the current flows into the fixed contact terminal 22*a*, the fixed contact 38*a*, the movable contact 36*a*, the first movable piece 18*a*, the coupling portion 18*c*, the second movable piece 18*b*, the movable contact 36*b*, the fixed contact 38*b* and the fixed contact terminal 22*b* in this order, as illustrated in FIG. 7A. Then, when the current which flows into the coil 30 is cut off, the armature 16 rotates counterclockwise illustrated in FIG. 7B by the restoring force of the hinge spring 14. Although the movable contacts 36*a* and 36*b* begin to separate from the fixed contacts 38*a* and 38*b* by the rotation of the armature 16, respectively, the current flowing between the movable contact 36*a* and the fixed contact 38*a* and the current flowing between the movable contact 36*b* and the fixed contact 38*b* are not completely interrupted, and the arc occurs between the fixed contacts 38*a* and 38*b* and the movable contacts 36*a* and 36*b*.

In the relay 1 illustrated in FIGS. 7A to 7C, the direction of the magnetic field is the depth direction toward the fixed contact terminal 22*b* from the fixed contact terminal 22*a* as illustrated in FIG. 7B in a place where the current flows from the fixed contact 38*a* to movable contact 36*a*. Therefore, the arc which occurs between the movable contact 36*a* and the fixed contact 38*a* is extended in a space in the upper direction by Lorentz force as indicated by an arrow A of FIG. 7B and extinguished. On the other hand, in a place where the current flows from the movable contact 36*b* to the fixed contact 38*b*, the direction of the magnetic field is the depth direction toward the fixed contact terminal 22*b* from the fixed contact terminal 22*a* as illustrated in FIG. 7C. Therefore, the arc which occurs between the movable contact 36*b* and the fixed contact 38*b* is extended in a space in the lower direction by Lorentz force as indicated by an arrow B of FIG. 7C and extinguished.

Therefore, according to FIGS. 6A to 7C, the relay 1 of the present embodiment can extend the arc which occurs between the movable contact 36*a* and the fixed contact 38*a* and the arc which occurs between the movable contact 36*b* and the fixed contact 38*b* in the spaces of the opposite direction at the same time, respectively, and extinguish them, regardless of the directions of the current flowing between the movable contact 36*a* and the fixed contact 38*a* and the current flowing between the movable contact 36*b* and the fixed contact 38*b*.

The fulcrums (e.g. the cutout portions 16*e*) of a movable member including the armature 16 and the movable contact spring 18 are arranged above the movable contacts 36*a* and 36*b* or the fixed contacts 38*a* and 38*b*, and the lower portions 22*d* of the fixed contact terminals 22*a* and 22*b* are arranged below the movable contacts 36*a* and 36*b* or the fixed contacts 38*a* and 38*b*. Therefore, even when the arc which occurs between the movable contact 36*a* and the fixed contact 38*a* is extended upward or downward according to the direction of the current flowing between the movable contact 36*a* and the fixed contact 38*a*, it is possible to secure the spaces for extending the arc. Similarly, even when the arc which occurs between the movable contact 36*b* and the fixed contact 38*b* is extended upward or downward according to the direction of the current flowing between the movable contact 36*b* and the fixed contact 38*b*, it is possible to secure the spaces for extending the arc.

In the following, a description will be given of a variation of the movable contact spring 18 and a variation of the fixed contact terminals 22*a* and 22*b*.

Figure 8A:
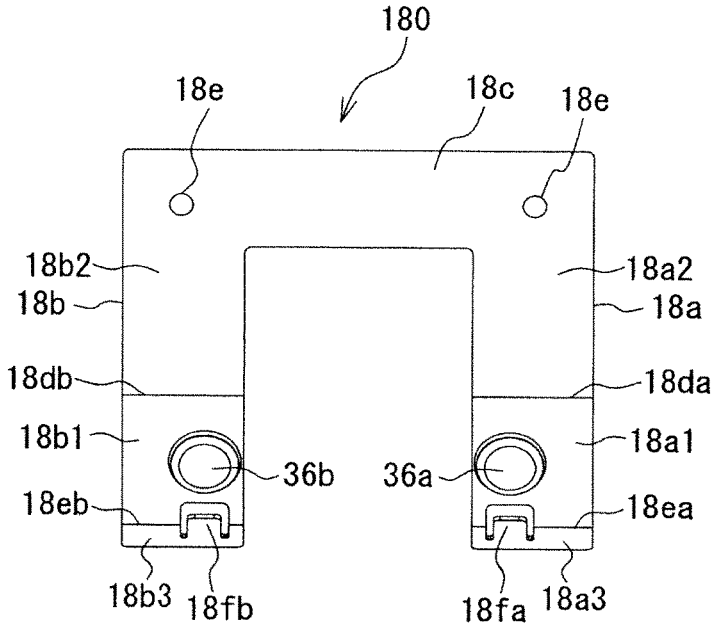
FIG. 8A is a front view of a movable contact spring 180.
Figure 8B:
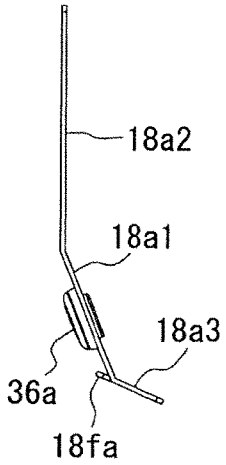
FIG. 8B is a side view of the movable contact spring 180.
Figure 8C:
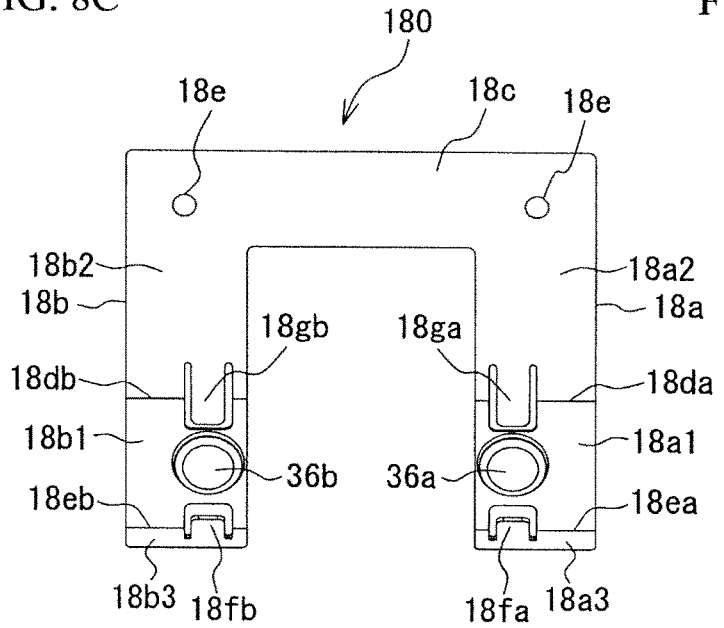
FIG. 8C is a front view of a variation of the movable contact spring 180.
Figure 8D:
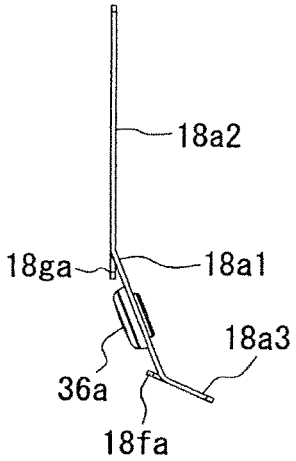
FIG. 8D is a side view of the variation of the movable contact spring 180.

FIG. 8A is a front view of a movable contact spring 180, and FIG. 8B is a side view of the movable contact spring 180. FIG. 8C is a front view of a variation of the movable contact spring 180, and FIG. 8D is a side view of the variation of the movable contact spring 180. Components of the movable contact spring 180 identical with those of the movable contact spring 18 of FIGS. 4A and 4B are designated by identical reference numerals.

The movable contact spring 180 is a conductive plate spring having a U shape in a front view, and includes the pair of movable pieces, i.e., the first movable piece 18*a* and the second movable piece 18*b*, and the coupling portion 18*c* that couples upper ends of the first movable piece 18*a* and the second movable piece 18*b* with each other.

The first movable piece 18*a* is bent twice at the position 18*da* nearer to the bottom end than the center and a position 18*ea* nearer to the bottom end than the position 18*da*. The second movable piece 18*b* is bent twice at the position 18*db* nearer to the bottom end than the center and a position 18*eb* nearer to the bottom end than the position 18*db*. Here, a portion below the position 18*ea* of the first movable piece 18*a* is defined as a lowest portion 18*a*3, a portion between the positions 18*ea* and 18*da* is defined as the lower portion 18*a*1, and a portion above the position 18*da* of the first movable piece 18*a* is defined as the upper portion 18*a*2. Similarly, a portion below the position 18*eb* of the second movable piece 18*b* is defined as a lowest portion 18*b*3, a portion between the positions 18*eb* and 18*db* is defined as the lower portion 18*b*1, and a portion above the position 18*db* of the second movable piece 18*b* is defined as the upper portion 18*b*2.

The movable contact 36*a* composed of the material having excellent arc resistance is provided on the lower portion 18*a*1 of the first movable piece 18*a*. The movable contact 36*b* composed of the material having excellent arc resistance is provided on the lower portion 18*b*1 of the second movable piece 18*b*. In the first movable piece 18*a* and the second movable piece 18*b*, the upper portion 18*a*2 and the lowest portion 18*a*3 of the first movable piece 18*a* and the upper portion 18*b*2 and the lowest portion 18*b*3 of the second movable piece 18*b* are bent in a direction away from the fixed contact terminals 22*a* and 22*b*, respectively.

The upper portions 18*a*2 and 18*b*2 function as an arc runner which moves the arc generated between the contacts to the space in the upper direction. The lowest portions 18*a*3 and 18*b*3 function as an arc runner which moves the arc generated between the contacts to the space in the lower direction.

Through-holes 18*e* into which the projections 16*f* provided on the suspended portion 16*b* are fitted are formed on the coupling portion 18*c*. The projections 16*f* are fitted and caulked into the through-holes 18*e*, so that the movable contact spring 18 is fixed to the first surface of the suspended portion 16*b* of the armature 16.

Formed on the first movable piece 18*a* is a cut-and-raised portion 18*fa* (a first cut-and-raised portion) that projects toward the movable contact 36*a* from the lowest portion 18*a*3 along a surface of the lowest portion 18*a*3 and inclines with respect to the lower portion 18*a*1. Moreover, formed on the second movable piece 18*b* is a cut-and-raised portion 18*fb* (the first cut-and-raised portion) that projects toward the movable contact 36*b* from the lowest portion 18*b*3 along a surface of the lowest portion 18*b*3 and inclines with respect to the lower portion 18*b*1. By the cut-and-raised portions 18*fa* and 18*fb* coupled with the lowest portions 18*a*3 and 18*b*3, a distance between the movable contact 36*a* and the lowest portion 18*a*3 (i.e., a member other than the contact) and a distance between the movable contact 36*b* and the lowest portion 18*b*3 are reduced. Therefore, the arc generated between the movable contact 36*a* and the fixed contact 38*a* and the arc generated between the movable contact 36*b* and the fixed contact 38*b* can quickly move from these contacts to the lowest portions 18*a*3 and 18*b*3 (i.e., the member other than the contact), respectively. Therefore, the cut-and-raised portions 18*fa* and 18*fb* can suppress the wear of the contacts.

Moreover, formed on the first movable piece 18*a* may be a cut-and-raised portion 18*ga* (a second cut-and-raised portion) that projects toward the movable contact 36*a* from the upper portion 18*a*2 so as to incline with respect to the lower portion 18*a*1 along a surface of the upper portion 18*a*2, as illustrated in FIGS. 8C and 8D. In addition, formed on the second movable piece 18*b* may be a cut-and-raised portion 18*gb* (the second cut-and-raised portion) that projects toward the movable contact 36*b* from the upper portion 18*b*2 so as to incline with respect to the lower portion 18*b*1 along a surface of the upper portion 18*b*2.

Figure 9A:
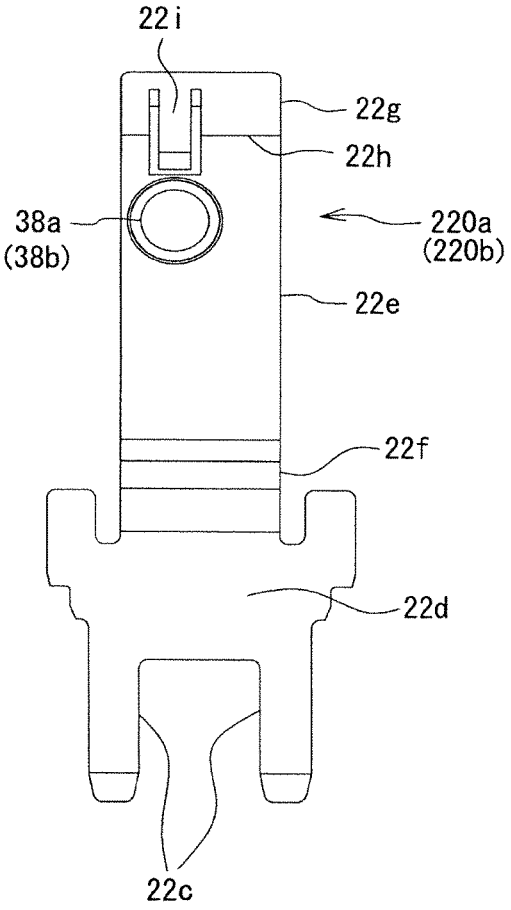
FIG. 9A is a front view of fixed contact terminals 220*a* and 220*b;*
Figure 9B:
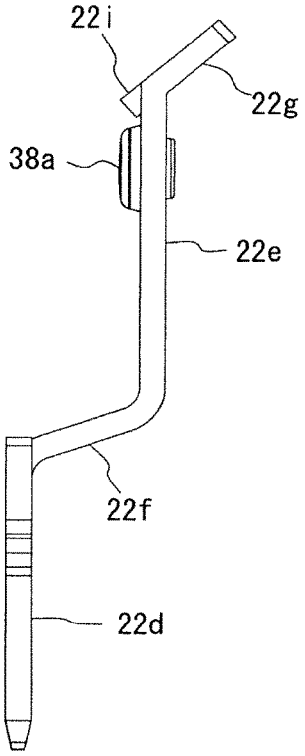
FIG. 9B is a side view of the fixed contact terminals 220*a* and 220*b;*

FIG. 9A is a front view of fixed contact terminals 220*a* and 220*b*, and FIG. 9B is a side view of the fixed contact terminals 220*a* and 220*b*. Components of the fixed contact terminals 220*a* and 220*b* identical with those of the fixed contact terminals 22*a* and 22*b* of FIGS. 4C and 4D are designated by identical reference numerals.

The fixed contact terminals 220*a* and 220*b* are press-fitted to through-holes, not shown, provided on the base 28 from above, and are fixed to the base 28. The fixed contact terminals 220*a* and 220*b* are bent like a crank in a side view. Each of the fixed contact terminals 220*a* and 220*b* includes an uppermost portion 22*g*, the upper portion 22*e*, the inclined portion 22*f* and the lower portion 22*d*. The upper portion 22*e* is bent so as to separate from the movable contact spring 180 or the insulating cover 20 than the lower portion 22*d*. The fixed contacts 38*a* and 38*b* composed of a material having excellent arc resistance are provided on the upper portions 22*e* of the fixed contact terminals 220*a* and 220*b*, respectively. The bifurcated terminal 22*c* to be connected to the power supply, not shown, is provided on the lower portions 22*d* of the fixed contact terminals 220*a* and 220*b*.

The fixed contact terminals 220*a* and 220*b* are different in the inclusion of the uppermost portion 22*g* from the fixed contact terminals 22*a* and 22*b* of FIG. 4C. The uppermost portion 22*g* is formed by bending the fixed contact terminals 220*a* and 220*b* at a position 22*h* higher than the fixed contacts 38*a* and 38*b*. In FIGS. 9A and 9B, a portion above the position 22*h* is the uppermost portion 22*g*, and a portion between the position 22*h* and the inclined portion 22*f* is the upper portion 22*e*.

The uppermost portion 22*g* is bent so as to separate from the movable contact spring 180 or the insulating cover 20 than the upper portion 22*e*. The uppermost portions 22*g* functions as an arc runner which moves the arc generated between the contacts to the space in the upper direction. Moreover, formed on the fixed contact terminals 220*a* and 220*b* is a cut-and-raised portion 22*i* (a third cut-and-raised portion) that projects toward the fixed contacts 38*a* and 38*b* from the uppermost portion 22*g* so as to incline with respect to the upper portion 22*e* along a surface of the uppermost portion 22*g*.

Figure 10A:
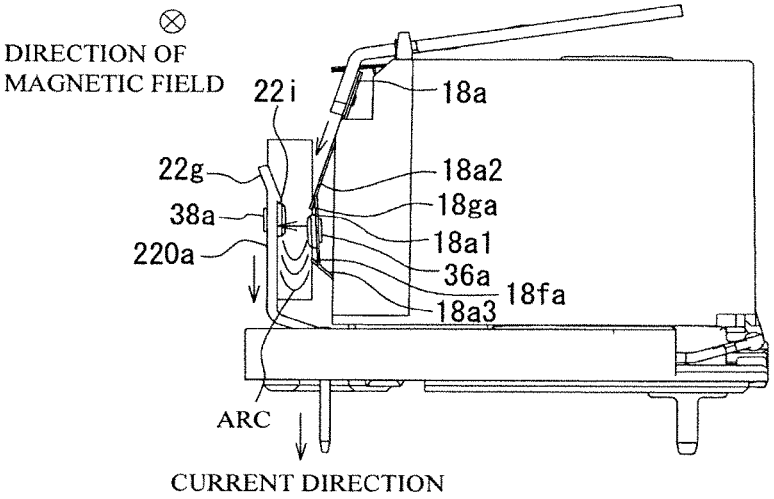
FIG. 10A is a diagram illustrating an arc-extinguishing state as viewed from a side of the fixed contact terminal 220*a;*
Figure 10B:
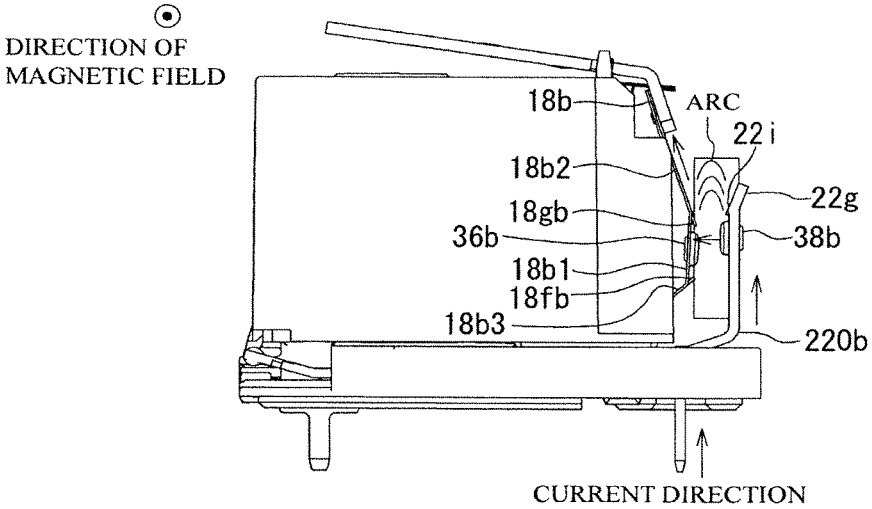
FIG. 10B is a diagram illustrating an arc-extinguishing state as viewed from a side of the fixed contact terminal 220*b;*

FIG. 10A is a diagram illustrating an arc-extinguishing state as viewed from the side of the fixed contact terminal 220*a*, and FIG. 10B is a diagram illustrating an arc-extinguishing state as viewed from the side of the fixed contact terminal 220*b*. In FIGS. 10A and 10B, a direction in which the current flows is indicates by arrows.

As illustrated in FIGS. 10A and 10B, the first movable piece 18*a* and the second movable piece 18*b* are bent in a direction in which the upper portion 18*a*2 and the lowest portion 18*a*3 of the first movable piece 18*a* and the upper portion 18*b*2 and the lowest portion 18*b*3 of the second movable piece 18*b* separate from the fixed contact terminals 220*a* and 220*b* opposite to the movable contacts 36*a* and 36*b*, respectively. Moreover, the uppermost portion 22*g* of the fixed contact terminals 220*a* and 220*b* is bent in the direction away from the movable contact spring 180 or the insulating cover 20.

Thereby, the uppermost portion 22*g*, the upper portion 18*a*2 and the upper portion 18*b*2 can quickly move the arc generated between the movable contact 36*a* and the fixed contact 38*a* and the arc generated between the movable contact 36*b* and the fixed contact 38*b* to the space in the upper direction, and can reduce the wear of the movable contacts 36*a* and 36*b* and the fixed contacts 38*a* and 38*b*. Especially, a gap between the uppermost portion 22*g* and the upper portions 18*a*2 and 18*b*2 gradually spreads in a horizontal direction of FIGS. 10A and 10B as going to the upper direction of FIGS. 10A and 10B. Moreover, a gap between the fixed contact terminal 220*a* and the lowest portion 18*b*3 gradually spreads in a horizontal direction of FIGS. 10A and 10B as going to the lower direction of FIGS. 10A and 10B. By gradually spreading the gaps, the arc moving upward or downward can be extended in a horizontal direction of FIGS. 10A and 10B, and be extinguished more effectively.

Similarly, the lowest portion 18*a*3 and 18*b*3 can quickly move the arc generated between the movable contact 36*a* and the fixed contact 38*a* and the arc generated between the movable contact 36*b* and the fixed contact 38*b* to the space in the lower direction, and can reduce the wear of the movable contacts 36*a* and 36*b* and the fixed contacts 38*a* and 38*b*.

Then, the cut-and-raised portion 22*i* is formed toward the fixed contacts 38*a* and 38*b* from the uppermost portion 22*g* functioning as the arc runner, so that the arc can be quickly moved to the arc runner, and the wear of the fixed contacts 38*a* and 38*b* can be reduced. Here, a reason why the formation of the cut-and-raised portions can quickly move the arc to the arc runner is that a distance in which the arc moves from the fixed contacts or the movable contacts to a member other than their contacts (here, the cut-and-raised portions coupled with the arc runner) is reduced compared with a case where the cut-and-raised portions are not formed. The cut-and-raised portions 18*ga* and 18*fa* are formed toward the movable contact 36*a* from the upper portion 18*a*2 functioning as the arc runner and the lowest portion 18*a*3, so that the arc can be quickly moved to the arc runner, and the wear of the movable contact 36*a* can be reduced. The cut-and-raised portions 18*gb* and 18*fb* are formed toward the movable contact 36*b* from the upper portion 18*b*2 functioning as the arc runner and the lowest portion 18*b*3, so that the arc can be quickly moved to the arc runner, and the wear of the movable contact 36*b* can be reduced.

Figure 11:
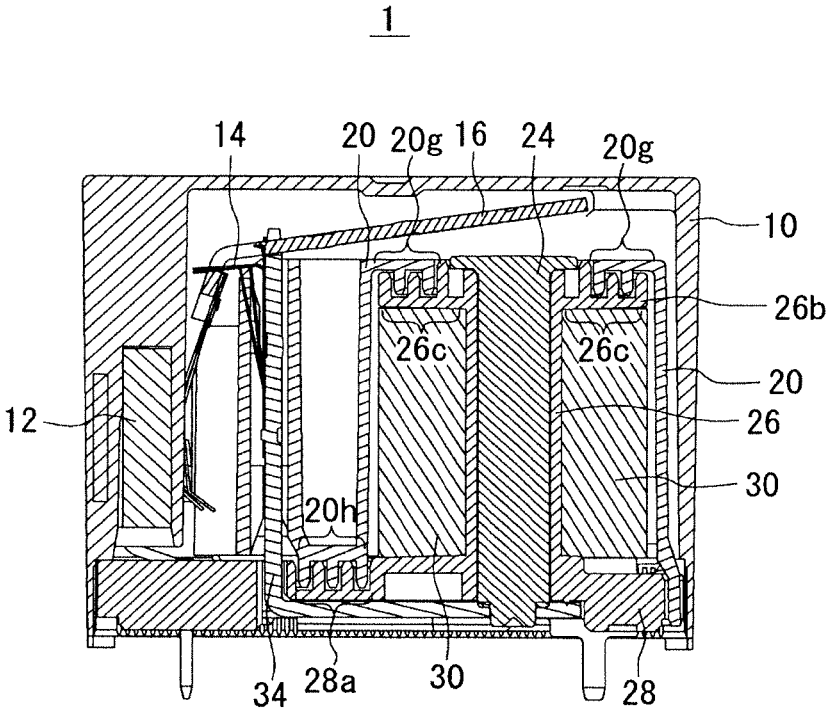
FIG. 11 is a cross-portion view of the relay 1.

FIG. 11 is a cross-portion view of the relay 1. The relay 1 is a direct current high voltage type relay. It is necessary to secure an insulating distance (i.e., a space and a creepage distance) between a strong electrical side (specifically, the armature 16, the movable contact spring 18, the fixed contact terminals 22*a* and 22*b*, the iron core 24 and the yoke 34) into which the current as a power to be supplied to a load flows, and a weak electrical side (specifically, the coil 30) into which a current for exciting the electromagnet flows. However, when the insulating distance is provided linearly inside the relay 1, the relay 1 increases in size.

For this reason, the spool 26 which is arranged between the head portion 24*a* of the iron core 24 and the coil 30 includes an uneven portion 26*c* (a third uneven portion) on the head portion 24*a*, as illustrated in FIG. 11. Moreover, the base 28 which is arranged between the coil 30 and the yoke 34 includes an uneven portion 28*a* (a fourth uneven portion) in its own part. In addition, an inner wall of the insulating cover 20 includes an uneven portion 20*g* (a first uneven portion) and an uneven portion 20*h* (a second uneven portion) at positions opposite to the uneven portion 26*c* and the uneven portion 28*a*, respectively.

The uneven portion 20*g* of the insulating cover 20 is fitted into the uneven portion 26*c* of the spool 26. These uneven portions are provided, so that the sufficient insulating distance can be secured between the head portion 24*a* of the iron core 24 and the coil 30 without increasing the relay 1 in size. Moreover, the uneven portion 20*h* of the insulating cover 20 is fitted into the uneven portion 28*a* of the base 28. Thereby, the sufficient insulating distance can be secured between the coil 30 and the yoke 34 without increasing the relay 1 in size.

Figure 12A:
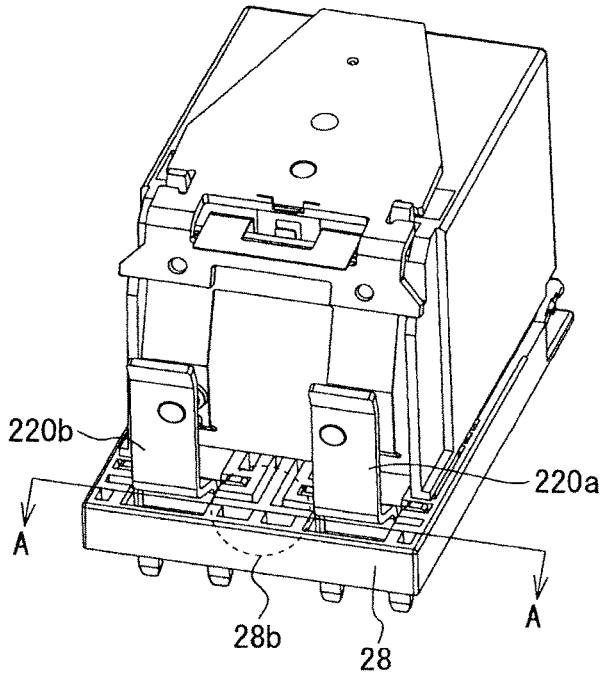
FIG. 12A is a perspective view of the electromagnetic relay 1 when the case 10 is removed.
Figure 12B:
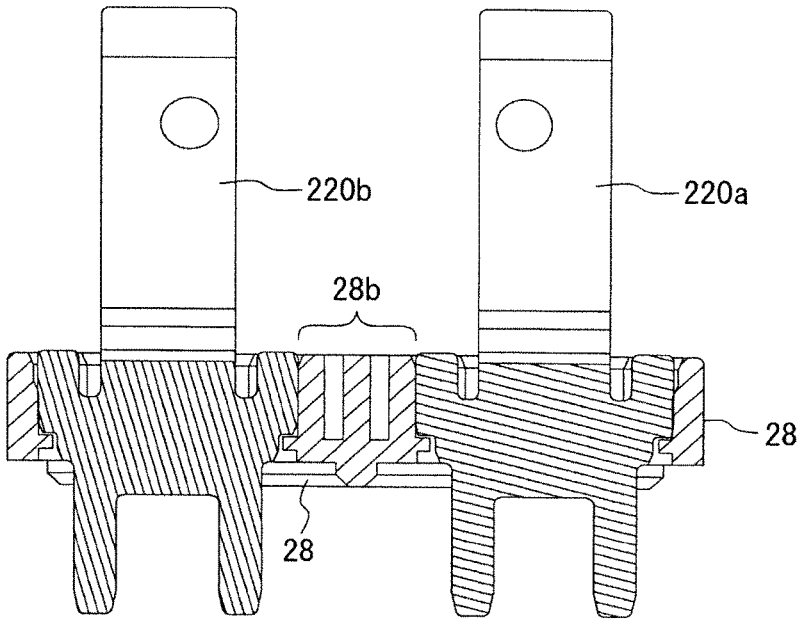
FIG. 12B is a cross-portion view taken along line A-A of FIG. 12A.

FIG. 12A is a perspective view of the electromagnetic relay 1 when the case 10 is removed. FIG. 12B is a cross-portion view taken along line A-A of FIG. 12A.

By dusts generated due to consumption of the movable contacts 36*a* and 36*b* and the fixed contacts 38*a* and 38*b*, an insulating performance between the fixed contact terminals 220*a* and 220*b* deteriorates, and tracking may occur. For this reason, the base 28 includes an uneven portion 28*b* (a fifth uneven portion) between the fixed contact terminals 220*a* and 220*b*, as illustrated in FIGS. 12A and 12B. Thereby, irregularities are formed between the fixed contact terminals 220*a* and 220*b*, so that the creepage distance between the fixed contact terminals 220*a* and 220*b* can be secured, and anti-tracking performance can be improved. Here, in FIGS. 12A and 12B, the fixed contact terminals 220*a* and 220*b* are used, but the fixed contact terminals 22*a* and 22*b* may be used.

Figure 13A:
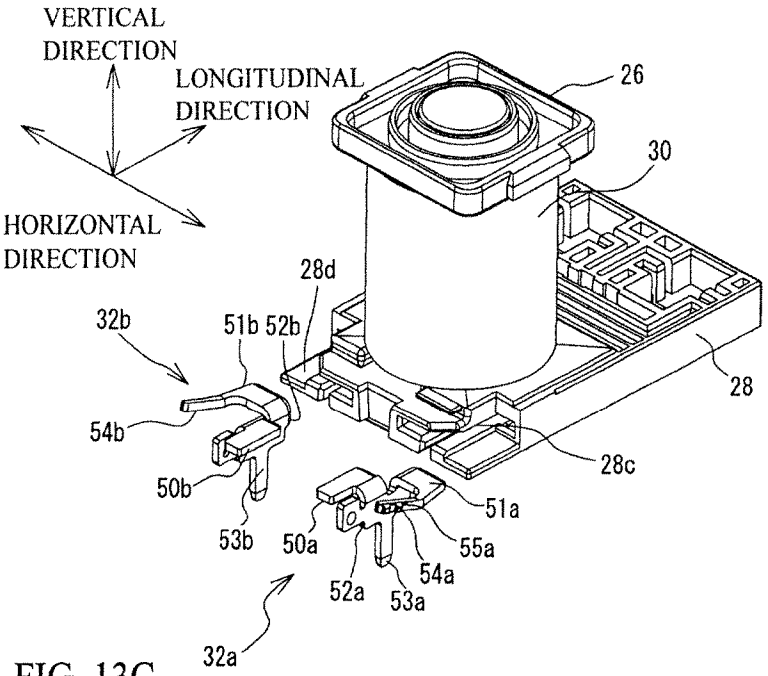
FIG. 13A is a diagram schematically illustrating the configuration of a base 28 and a pair of coil terminals 32.
Figure 13B:
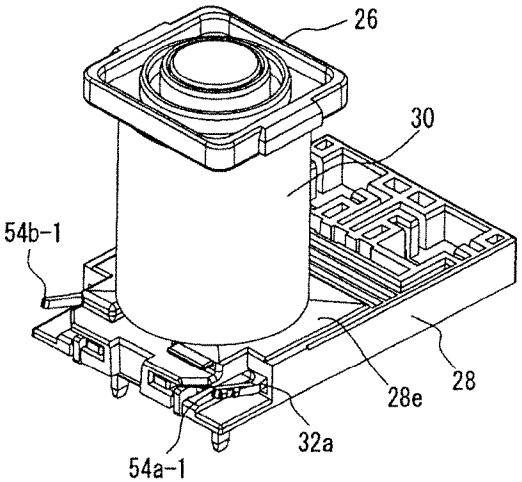
FIG. 13B is a diagram illustrating a state where the pair of coil terminals 32 is pressed into the base 28.
Figure 13C:
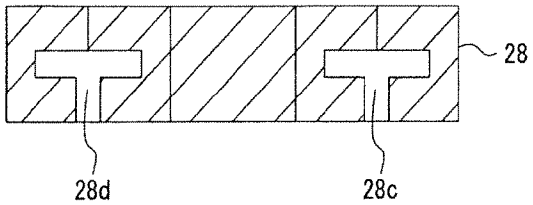
FIG. 13C is a rear view of the base 28.
Figure 13D:
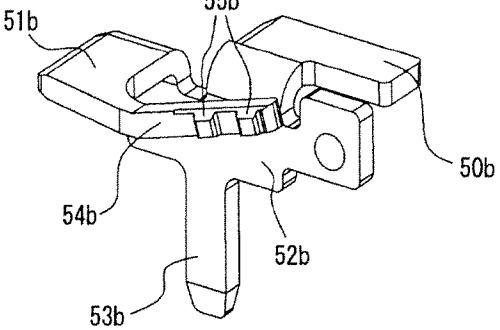
FIG. 13D is a diagram illustrating a coil terminal 32*b;*
Figure 14:
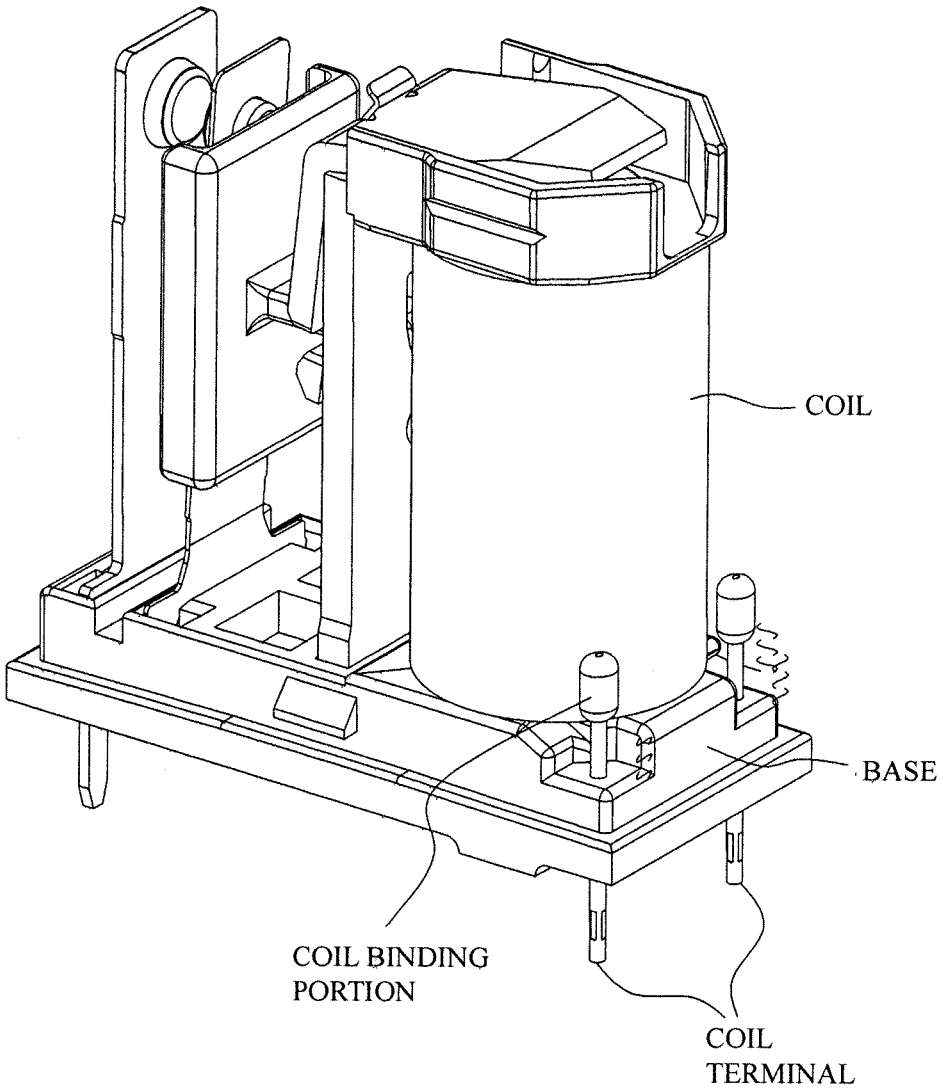
FIG. 14 is a diagram illustrating a coil terminal mounted on a conventional relay.

FIG. 13A is a diagram schematically illustrating the configuration of the base 28 and the pair of coil terminals 32. FIG. 13B is a diagram illustrating a state where the pair of coil terminals 32 is pressed into the base 28. FIG. 13C is a rear view of the base 28. FIG. 13D is a diagram illustrating the coil terminal 32*b*. Here, a side in which the pair of coil terminals 32 is press-fitted is a rear surface of the relay 1. FIG. 14 is a diagram illustrating a coil terminal mounted on a conventional relay.

As illustrated in FIG. 14, conventional coil terminals have a rod-like shape, and are press-fitted from above the base. Then, coil binding portions of the coil terminal are arranged adjacent to the coil (e.g. see a relay of Japanese Laid-open Patent Publication No. 2013-80692). Therefore, to wind the coil, the coil binding portions of the coil terminals are bent in a direction away from the coil. Then, after having finished winding the coil, the bending-back of the coil binding portions is performed to return the coil binding portions to a state illustrated in FIG. 14. However, the slack and the disconnection of the coil may occur due to the bending-back of the coil binding portions.

In coil terminals 32*a* and 32*b* of the present invention, such a bending-back of the coil binding portions is unnecessary.

The coil terminal 32*a* is press-fitted into a T-shaped hole 28*c* provided on a rear surface of the base 28 in a rear view, and the coil terminal 32*b* is press-fitted into a T-shaped hole 28*d* provided on the rear surface of the base 28 in the rear view (see FIG. 13C).

As illustrated in FIG. 13A, the coil terminal 32*a* is formed by bending a piece of metal plate, and includes a first horizontal portion 50*a* and a second horizontal portion 51*a* that are press-fitted into the T-shaped hole 28*c* and restrict the movement of the coil terminal 32*a* in a vertical direction, and a vertical portion 52*a* that restrict the movement of the coil terminal 32*a* in a horizontal direction. The first horizontal portion 50*a* and the second horizontal portion 51*a* are provided to invert each other horizontally from a top part of the vertical portion 52*a*. Moreover, the first horizontal portion 50*a* and the second horizontal portion 51*a* are provided so as to be mutually shifted in a longitudinal direction.

In addition, the coil terminal 32*a* extends vertically downward from the vertical portion 52*a*, includes: a leg portion 53*a* that are connected to a power supply, not shown; a coil binding portion 54*a* that is stood in an oblique direction from one end of the second horizontal portion 51*a*; and a projecting portion 55*a* that defines a winding position of the coil 30.

As with the coil terminal 32*a*, the coil terminal 32*b* includes: a first horizontal portion 50*b* and a second horizontal portion 51*b* that restrict the movement of the coil terminal 32*b* in the vertical direction; a vertical portion 52*b* that restricts the movement of the coil terminal 32*b* in a horizontal direction; a leg portion 53*b* that extends vertically downward from the vertical portion 52*b*, and is connected to the power supply, not shown; a coil binding portion 54*b* that is stood at a sharp angle from one end of the second horizontal portion 51*b*; and a projecting portion 55*b* that defines the winding position of the coil 30 (see FIG. 13D).

As illustrated in FIG. 13B, the base 28 does not exist at positions corresponding to the coil binding portions 54*a* and 54*b*, and the coil binding portions 54*a* and 54*b* are exposed from the base 28 in a state where the coil terminals 32*a* and 32*b* are press-fitted into the base 28. It is preferable that an edge 54*a*-1 of the coil binding portion 54*a* and an edge 54*b*-1 of the coil binding portion 54*b* are arranged at positions lower than an upper surface 28*e* of the base 28, as illustrated in FIG. 13B. In this case, the coil 30 can be wound around the spool 26 without considering the coil binding portions 54*a* and 54*b*.

Thus, the coil binding portions 54*a* and 54*b* are stood at the sharp angle from the horizontal portions (the second horizontal portions 51*a* and 51*b*) of the coil terminals 32*a* and 32*b*, and hence a space necessary to wind the coil 30 around the spool can be secured. According to the coil terminals 32*a* and 32*b*, the bending-back of the coil binding portions is unnecessary, and the slack and the disconnection of the coil 30 can be avoided.

Figure 15A:
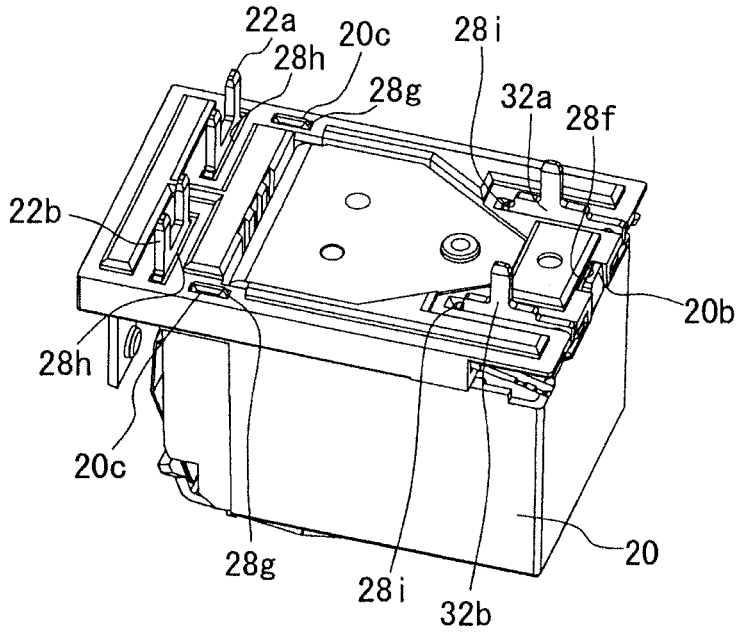
FIG. 15A is a bottom view of the relay 1 when the case 10 is not mounted.
Figure 15B:
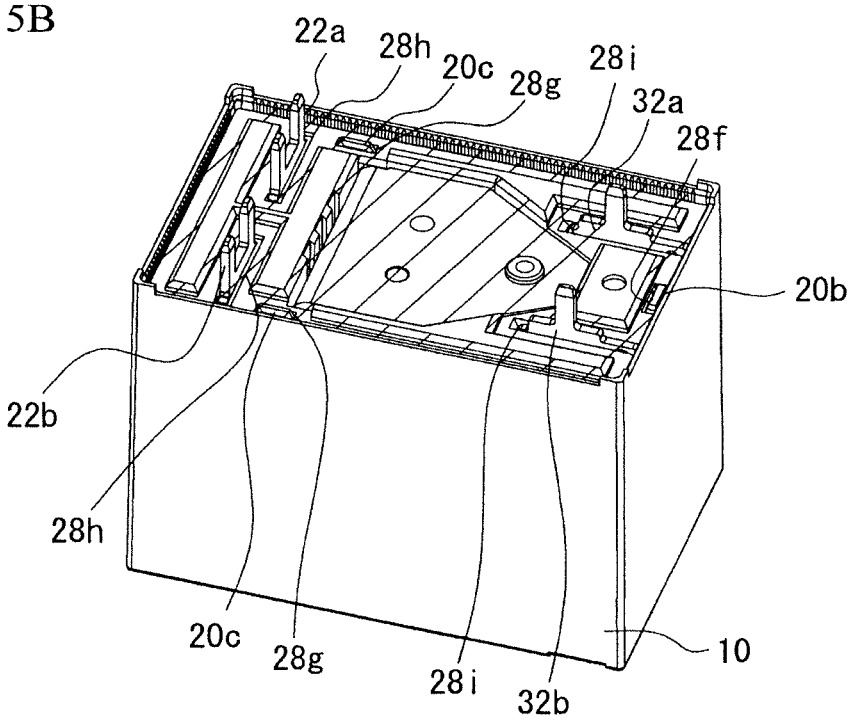
FIG. 15B is a bottom view of the relay 1 when the case 10 is mounted.

FIG. 15A is a bottom view of the relay 1 when the case 10 is not mounted. FIG. 15B is a bottom view of the relay 1 when the case 10 is mounted.

As illustrated in FIG. 15A, the base 28 includes: a recess portion 28*f* that engages with a projection-shaped fixing portion 20*b* formed on a bottom of the insulating cover 20; through-holes 28*g* (a first through-hole) into which projection-shaped fixing portions 20*c* formed on the bottom of the insulating cover 20 are inserted; through-holes 28*h* (a second through-hole) into which the fixed contact terminals 22*a* and 22*b* are press-fitted; and holes 28*i* into which the vertical portion 52*a* of the coil terminal 32*a* and the vertical portion 52*b* of the coil terminal 32*b* are press-fitted.

In the present embodiment, the fixed contact terminals 22*a* and 22*b* are press-fitted into the through-holes 28*h*, and the vertical portion 52*a* of the coil terminal 32*a* and the vertical portion 52*b* of the coil terminal 32*b* are press-fitted into the holes 28*i*. The fixing portion 20*b* is engaged with the recess portion 28*f* of the base 28, the fixing portions 20*c* are inserted into the through-holes 28*g* of the base 28, and then the case 10 is attached to the base 28 and the bottom of the base 28 is adhered with an adhesive. An oblique line portion of FIG. 15B illustrates a portion where the adhesive is applied.

In this case, in a process of adhering the fixed contact terminals 22*a* and 22*b* and the coil terminals 32*a* and 32*b* to the base 28, the insulating cover 20 can be adhered to the base 28 at the same time. Compared with a case where the process of adhering the insulating cover 20 to the base 28 and the process of adhering the fixed contact terminals 22*a* and 22*b* and the coil terminals 32*a* and 32*b* to the base 28 are performed separately, it is possible to reduce the adhering process and the manufacturing cost.

As described above, according to the above-mentioned embodiment, in the hinge type relay 1 that moves the movable contact spring 18 by rotary motion of the armature 16, the permanent magnet 12 for arc-extinguishing is arranged between the fixed contact terminal 22*a* and the first movable piece 18*a*, and the fixed contact terminal 22*b* and the second movable piece 18*b*. The fulcrums (e.g. the cutout portions 16*e*) of the movable member including the armature 16 and the movable contact spring 18, and the lower portions 22*d* of the fixed contact terminals 22*a* and 22*b* are arranged mutually in opposite directions with respect to the movable contacts 36*a* and 36*b* or the fixed contacts 38*a* and 38*b*.

Thereby, it is possible to extend the arc toward the fulcrums of the movable member, and further to extend the arc toward the fixed contact terminals 22*a* and 22*b*. That is, two directions for extending the arc which are the opposite directions to each other can be secured, and hence the arc can be extinguished effectively regardless of the direction of the current flowing between the contacts.

Some preferred embodiments of the present invention have been described in detail, but the present invention is not limited to these specifically described embodiments but may have various variations and alterations within the scope of the claimed invention.

The invention claimed is:

1. An electromagnetic relay comprising:

a base;

a pair of fixed terminals each including a fixed contact and a lower portion fixed to the base;

a movable spring including a pair of movable pieces, each of the movable pieces including a movable contact contacting and separating from the fixed contact;

an armature that is coupled with the movable spring, and moves the movable spring by a rotary motion around a fulcrum;

an electromagnetic device that drives the armature; and a permanent magnet that is arranged between the pair of fixed terminals, and generates a magnetic field, wherein the lower portion and the fulcrum are arranged mutually in opposite directions with respect to the movable contact or the fixed contact, the fixed terminals include a first fixed contact and a second fixed contact, the movable spring includes a first movable contact and a second movable contact, the electromagnetic device is arranged so that an arc generated between the first fixed contact and the first movable contact and an arc generated between the second fixed contact and the second movable contact are extended mutually in opposite directions, when a direction of a current flowing between the first movable contact and the first fixed contact and between the second movable contact and the second fixed contact is a first direction, the arc generated between the first movable contact and the first fixed contact is extended in a third direction, and the arc generated between the second movable contact and the second fixed contact is extended in a fourth direction opposite to the third direction, and when the direction of the current flowing between the first movable contact and the first fixed contact and between the second movable contact and the second fixed contact is a second direction opposite to the first direction, the arc generated between the first movable contact and the first fixed contact is extended in the fourth direction, and the arc generated between the second movable contact and the second fixed contact is extended in the third direction.

2. The electromagnetic relay according to claim 1, wherein each of the pair of movable pieces includes an upper portion, and a lower portion on which the movable contact is mounted and that is bent from the upper portion away from the fixed contact opposite to the movable contact.

3. The electromagnetic relay according to claim 2, wherein each of the pair of movable pieces further includes a lowest portion that is bent from the lower portion.

4. The electromagnetic relay according to claim 3, wherein each of the pair of movable pieces includes a first cut-and-raised portion that projects toward the movable contact from the lowest portion.

5. The electromagnetic relay according to claim 2, wherein each of the pair of movable pieces includes a second cut-and-raised portion that projects toward the movable contact from the upper portion.

6. The electromagnetic relay according to claim 1, wherein each of the pair of fixed terminals includes an upper portion on which the fixed contact is mounted, and an uppermost portion that is arranged above the fixed contact and is bent in a direction away from the movable spring.

7. The electromagnetic relay according to claim 6, wherein each of the pair of fixed terminals includes a third cut-and-raised portion that projects toward the fixed contact from the uppermost portion.

8. The electromagnetic relay according to claim 1, further comprising:

an insulating cover that covers the electromagnetic device and a part of the base, and include a first uneven portion and a second uneven portion, wherein the electromagnetic device includes a third uneven portion opposite to the first uneven portion of the insulating cover, the base includes a fourth uneven portion opposite to the second uneven portion of the insulating cover, and when the insulating cover is mounted on the base, the first uneven portion and the second uneven portion are fitted into the third uneven portion and the fourth uneven portion, respectively.

9. The electromagnetic relay according to claim 8, comprising:

a stopper that is formed integrally with the insulating cover, and contacts the movable spring when the electromagnetic device is turned off.

10. The electromagnetic relay according to claim 1, wherein the base includes a fifth uneven portion between the pair of fixed terminals.

11. The electromagnetic relay according to claim 1, comprising:

a coil terminal electrically connected to a coil included in the electromagnetic device, wherein the coil terminal includes a coil binding portion exposed from the base in a state where the coil terminal is press-fitted into the base, the coil binding portion is stood at a sharp angle from a horizontal portion of the coil terminal.

12. The electromagnetic relay according to claim 11, wherein an edge of the coil binding portion is arranged lower than an upper surface of the base.

13. The electromagnetic relay according to claim 11, wherein the insulating cover includes a plurality of fixing portions to fix the insulating cover to the base, the base includes a recess portion that engages with a first fixing portion among the plurality of fixing portions, a first through-hole into which a second fixing portion among the plurality of fixing portions is inserted, a second through-hole into which the pair of fixed terminals is press-fitted, and a hole into which the coil terminal is press-fitted, and the plurality of fixing portions, the pair of fixed terminals and the coil terminal are collectively fixed to the base by adhering an adhesive to the bottom of the base.

* * * * *